US011346298B2

(12) United States Patent
Suzuki et al.

(10) Patent No.: US 11,346,298 B2
(45) Date of Patent: May 31, 2022

(54) CONTROL DEVICE

(71) Applicant: DENSO CORPORATION, Kariya (JP)

(72) Inventors: Hiroshi Suzuki, Kariya (JP); Yasuhiro Kawakatsu, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/299,308

(22) Filed: Mar. 12, 2019

(65) Prior Publication Data

US 2019/0285021 A1 Sep. 19, 2019

(30) Foreign Application Priority Data

Mar. 13, 2018 (JP) ..... JP2018-045012

(51) Int. Cl.
*F02D 41/24* (2006.01)
*F02D 41/14* (2006.01)

(52) U.S. Cl.
CPC ..... *F02D 41/2454* (2013.01); *F02D 41/1445* (2013.01); *F02D 41/1454* (2013.01); *F02D 41/2467* (2013.01)

(58) Field of Classification Search
CPC ..... F02D 41/1454; F02D 41/1445; F02D 41/2454; F02D 41/2487; F02D 41/2422
USPC ..... 123/674
See application file for complete search history.

(56) References Cited

U.S. PATENT DOCUMENTS 4,676,215 A * 6/1987 Blocher ..... F02D 41/1408 123/339.19
5,106,481 A * 4/1992 Rankin ..... G01N 27/4065 204/426
5,243,951 A * 9/1993 Nakaniwa ..... F02D 41/1454 123/674
5,713,332 A 2/1998 Adler et al.
5,752,492 A 5/1998 Kato et al.
2004/0255902 A1* 12/2004 Sawada ..... F02D 31/001 123/339.11
2006/0021325 A1 2/2006 Ikemoto et al.
2012/0253634 A1 10/2012 Jiang et al.
(Continued)

FOREIGN PATENT DOCUMENTS

DE 43 04 441 A1 8/1994
DE 10 2005 039 012 A1 2/2007
(Continued)

*Primary Examiner* — Logan M Kraft
*Assistant Examiner* — Joshua Campbell
(74) *Attorney, Agent, or Firm* — Nixon & Vanderhye P.C.

(57) ABSTRACT

In a control device for an internal combustion engine, a learning map includes at least one partitioned operating region. The at least one partitioned operating region corresponds to at least one of operating conditions of the internal combustion engine. The learning map includes a value of at least one control parameter stored in the at least one partitioned operating region. A control unit controls the internal combustion engine in accordance with the at least one control parameter. An updating unit learns a value of the at least one control parameter for the at least one of the operating conditions, thus performing an updating of the value of the at least one control parameter stored in the at least one partitioned operating region to the learned value. A partition changing unit changes a partition pattern of the learning map.

19 Claims, 15 Drawing Sheets

(56) References Cited

U.S. PATENT DOCUMENTS

| | | | | |
|---|---|---|---|---|
| 2012/0324864 | A1* | 12/2012 | Krengel | F02D 41/1441 60/274 |
| 2015/0152804 | A1 | 6/2015 | Sakayanagi et al. | |
| 2017/0292433 | A1 | 10/2017 | Hayashita | |
| 2018/0363582 | A1 | 12/2018 | Ono et al. | |

FOREIGN PATENT DOCUMENTS

| | | | | |
|---|---|---|---|---|
| EP | 0241030 | A2 * | 10/1987 | F02D 41/2454 |
| JP | 8-254146 | | 10/1996 | |
| JP | 10-73043 | | 3/1998 | |
| JP | 2000156998 | A * | 6/2000 | |
| JP | 2001-152913 | | 6/2001 | |
| JP | 2002-13432 | | 1/2002 | |
| JP | 2002-227690 | | 8/2002 | |
| JP | 2006-63840 | | 3/2006 | |
| JP | 2006-144721 | | 6/2006 | |
| JP | 2006-152840 | | 6/2006 | |
| JP | 2007-285190 | | 11/2007 | |
| JP | 2010-138705 | | 6/2010 | |
| JP | 2011-241697 | | 12/2011 | |
| JP | 2011-252472 | | 12/2011 | |
| JP | 2013-7278 | | 1/2013 | |
| JP | 2013-130169 | | 7/2013 | |

* cited by examiner

CONTROL DEVICE

CROSS-REFERENCE TO RELATED APPLICATION

This application is based on and claims the benefit of priority from earlier Japanese Patent Application No. 2018-45012 filed on Mar. 13, 2018, the description of which is incorporated herein by reference.

TECHNICAL FIELD

The present disclosure relates to a control device for an internal combustion engine.

BACKGROUND

In a vehicle driven by an internal combustion engine, a control device is provided for controlling the internal combustion engine.

SUMMARY

A control device for an internal combustion engine according to an exemplary aspect of the present disclosure includes a learning map that includes at least one partitioned operating region. The at least one partitioned operating region corresponds to at least one of operating conditions of the internal combustion engine. The learning map also includes a value of at least one control parameter stored in the at least one partitioned operating region.

The control device includes a control unit that controls the internal combustion engine in accordance with the at least one control parameter.

The control device includes an updating unit that learns a value of the at least one control parameter for the at least one of the operating conditions, thus performing an updating of the value of the at least one control parameter stored in the at least one partitioned operating region to the learned value.

The control device includes a partition changing unit that changes a partition pattern of the learning map.

BRIEF DESCRIPTION OF THE DRAWINGS

Other aspects of the present disclosure will become apparent from the following description of embodiments with reference to the accompanying drawings in which:

FIG. 2 is an internal cross-sectional view of an air-fuel sensor illustrated in

FIG. 1;

DETAILED DESCRIPTION OF EMBODIMENT

Inventor's View Point

Figure 1:
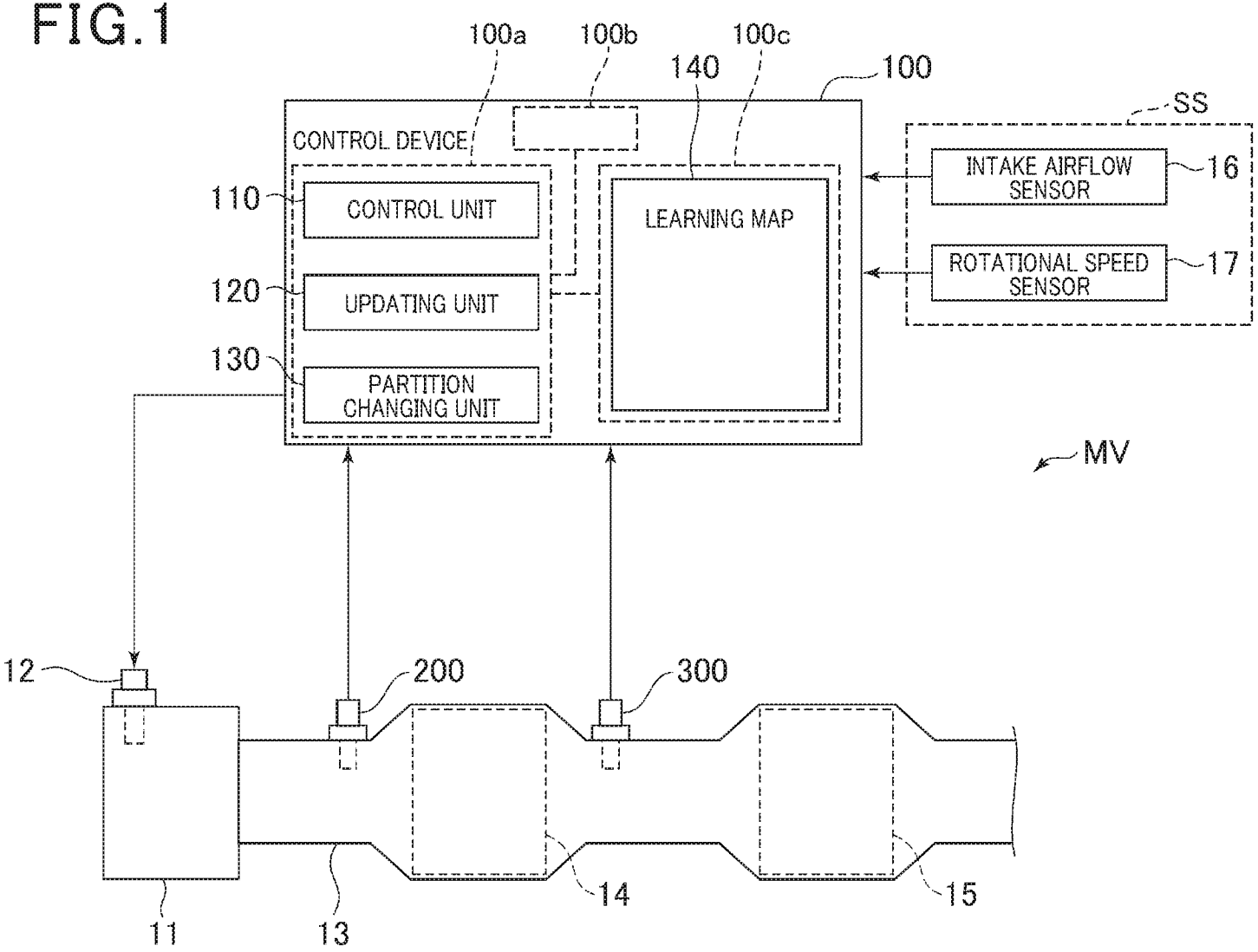
FIG. 1 is an overall structural diagram schematically illustrating a vehicle including a control device according to the first embodiment of the present disclosure.

Such a control device controls the internal combustion engine to thereby perform proper combustion of an air-fuel mixture in the internal combustion engine. This aims to prevent harmful components, such as nitrogen oxides, contained in exhaust gas from being discharged from the internal combustion engine via an exhaust pipe.

In particular, such a control device for an internal combustion engine adjusts the amount of fuel to be supplied to the internal combustion engine to a predetermined target amount, thus reducing the amount of harmful components contained in the exhaust gas.

The exhaust pipe of an internal combustion engine is commonly provided with a catalyst capable of occluding oxygen and emitting occluded oxygen. The catalyst aims to clean exhaust gas discharged from the internal combustion engine, thus further reducing the amount of harmful components contained in the exhaust gas.

Such control devices for an internal combustion engine control the internal combustion engine using at least one control parameter, such as a target amount of fuel set forth above; the at least one control parameter varies depending on the operating conditions of the internal combustion engine, referred to simply as an engine. For example, these control devices determine values of the at least one control parameter using a learning map. The learning map is information indicative of a correspondence relationship between (1) Each operating condition of the engine (2) A value of the at least one control parameter that should be set for the corresponding operating condition of the engine For example, an example of such a learning map has grid data points in each of which a value of the at least one control parameter for a corresponding one of the operating conditions is stored. That is, each data point of the learning map represents a corresponding one of the operating conditions of the engine. The control device refers to the learning map, and extracts, from the learning map, a value of the at least one control parameter that is suitable for the actual operating condition of the engine.

The value of the at least one control parameter, which has been set to be suitable for each operating condition of the engine, is not necessarily fixed.

For example, a value of at least one control parameter, which has been set to be suitable for a selected operating condition of the engine installed in a first vehicle, may be different from a value of the same at least one control parameter, which has been set to be suitable for the same operating condition of the engine installed in a second vehicle, due to individual differences between the first and second vehicles.

As another example, a value of at least one control parameter, which has been set to be suitable for a selected operating condition of the engine, may be changed to another value depending on, for example, change in state of the catalyst.

For addressing such an issue, there is a method of updating, at each of the grid data points of the learning map, the corresponding value of at least one control parameter to another value.

Such an updating method preferably updates, at a selected grid data point of the learning map, the corresponding value of the at least one control parameter to another value each time the actual operating condition of the engine changes to another operating condition; the selected grid data point is associated with the actual operating condition of the engine. For this reason, a range of already-updated points in the learning map may expand over time as the operating condition of the engine changes over time.

The learning map set forth above is designed to have the constant number of grid data points whose distribution is unchanged.

A large number of grid data points of the learning map may therefore increase time required for the control device to completely update values at all the grid data points of the learning map. In other words, it requires a large amount of time for the control device to have completed updating of all the values of at least one control parameter that are associated with all the operating conditions of the engine.

In addition, if some specific operating conditions in the operating conditions of the engine are only used for users who mostly use their vehicles for short distances, values of at least one control parameter, which are unassociated with the specific operating conditions so that they need not be updated, may remain while being non-updated.

For addressing such issues, we consider a method of updating values of at least one control parameter, which are associated with the actual operating condition of the vehicle, and also updating other values of the at least one control parameter, which are unassociated with the actual operating condition, in accordance with the updated values of the at least one control parameter.

This method enables many values of at least one control parameter to be updated at one time, making shorter time required for the control device to have completed updating of all the values of the at least one control parameter.

Unfortunately, this method simultaneously updates the other values of the at least one control parameter, which are unassociated with the actual operating condition, in addition to the values of the at least one control parameter, which are associated with the actual operating condition. For this reason, even if a long time has elapsed since the updating operation, the other values of the at least control parameter cannot be updated to higher-accuracy values based on the respectively corresponding operating conditions of the engine.

As described above, the conventional technology may fail to disclose or suggest any consideration of compatibility between a method of setting values of at least one control parameter, which are associated with an actual operating condition of the engine faster and a method of finally setting values of the at least one control parameter with higher accuracy.

EMBODIMENT

From the above inventor's viewpoint, the following describes embodiments of the present disclosure with reference to the accompanying drawings. In the embodiments, like parts between the embodiments, to which like reference characters are assigned, are omitted or simplified to avoid redundant description.

First Embodiment

A control device 100 according to the first embodiment is provided for a vehicle MV and configured to control an internal combustion engine 11, referred to simply as an engine 11.

The following describes an example of the structure of the vehicle MV first before describing an example of the structure of the control device 100.

The vehicle MV includes the engine 11, an exhaust passage 13, an upstream cleaning catalytic converter 14, a downstream cleaning catalytic converter 15, various sensors SS including an intake airflow sensor 16 and a rotational speed sensor 17, an upstream sensor 200, and a downstream sensor 300.

The engine 11 is configured to burn air and fuel supplied thereinto to thereby generate drive power for driving the vehicle MV. The vehicle MV includes an injector, i.e. a fuel delivery valve, 12 provided for the engine 11. The injector 12 is controlled to open, so that high pressure fuel is injected into the engine 11 via the injector 12 from an unillustrated injection system. The injector 12 is also controlled to close, so that the supply of the high pressure fuel into the engine 11 via the injector 12 is stopped. The control device 100 is configured to control opening or closing of the injector 12.

The exhaust passage 13 guides exhaust gas emitted from the engine 11 to the outside of the vehicle MV.

Each of the upstream and downstream cleaning catalytic converters 14 and 15 provided in the exhaust passage 13. Each of the upstream and downstream cleaning catalytic converters 14 and 15, which will be referred to simply as upstream and downstream catalytic converters 14 and 15, is designed as a three-way catalyst for cleaning exhaust gas flowing through the exhaust passage 13. Each of the upstream and downstream catalytic converters 14 and 15 is comprised of, for example, a ceramic substrate, a noble metal catalytic material made of, for example, platinum, a support material made of, for example, alumina, and a material made of, for example, ceria, such that the ceramic substrate supports these materials. Each of the catalytic converters 14 and 15 works to simultaneously clean both nitrogen oxides and unburned gas containing hydrocarbons and/or carbon monoxide.

The upstream and downstream catalytic converters 14 and 15 are arranged in the exhaust passage 13 in this order along the flow of the exhaust gas. Specifically, the downstream catalytic converter 15 is located downstream of the upstream catalytic converter 14.

The various sensors SS are each operative to measure a parameter, i.e. an operating condition parameter, constituting the actual operating condition of the engine 11.

Specifically, the intake airflow sensor 16 is comprised of, for example, an airflow meter, and operative to measure the intake-air rate at which intake air is supplied to enter the engine 11, i.e. measure the amount of intake air supplied to enter the engine 11. For example, the intake airflow sensor 16 is disposed in an unillustrated intake pipe communicably coupled to the engine 11. The intake airflow sensor 16 outputs the intake-air rate to the control device 100 as an operating condition parameter.

The rotational speed sensor 17 is capable of measuring the rotational speed, i.e. the RPM, of an unillustrated crankshaft of the engine 11, and outputting, to the control device 100, the rotational speed of the crankshaft as the rotational speed of the engine 11 as an operating condition parameter.

This enables the control device 100 to determine the operating condition of the engine 11 in accordance with the operating condition parameters measured by the respective sensors SS.

The upstream sensor 200 is an air-fuel ratio sensor for measuring an air-fuel ratio of the engine 11 using the exhaust gas flowing through the exhaust passage 13. The upstream sensor 200 is configured to change an output signal, such as an output current, depending on the air-fuel ratio, such as the concentration of oxygen in the exhaust gas. The upstream sensor 200 is located upstream of the upstream catalytic converter 14. That is, the upstream sensor 200 is arranged to measure the air-fuel ratio of the engine 11 based on a part of the exhaust gas located upstream of the upstream catalytic converter 14. The upstream sensor 200 outputs, to the control device 100, the air-fuel ratio measured thereby.

The downstream sensor 300 is an air-fuel ratio sensor for measuring the air-fuel ratio of the engine 11 using the exhaust gas flowing through the exhaust passage 13. The downstream sensor 300, which has the same structure as that of the upstream sensor 200, is configured to change the output signal, such as the output current, depending on the air-fuel ratio, such as the concentration of oxygen in the exhaust gas. The downstream sensor 300 is located downstream of the upstream catalytic converter 14. That is, the downstream sensor 300 is arranged to measure the air-fuel ratio of the engine 11 based on a part of the exhaust gas located downstream of the upstream catalytic converter 14. The downstream sensor 300 outputs, to the control device 100, the air-fuel ratio measured thereby.

Note that the following describes simply the air-fuel ratio in a case where either the air-fuel ratio measured by the upstream sensor 200 or the air-fuel ratio measured by the downstream sensor 300 can be used, and describes separately the air-fuel ratio measured by the upstream sensor 200 and the air-fuel ratio measured by the downstream sensor 300 in a case where any one of the air-fuel ratio measured by the upstream sensor 200 and the air-fuel ratio measured by the downstream sensor 300 is used.

Figure 2:
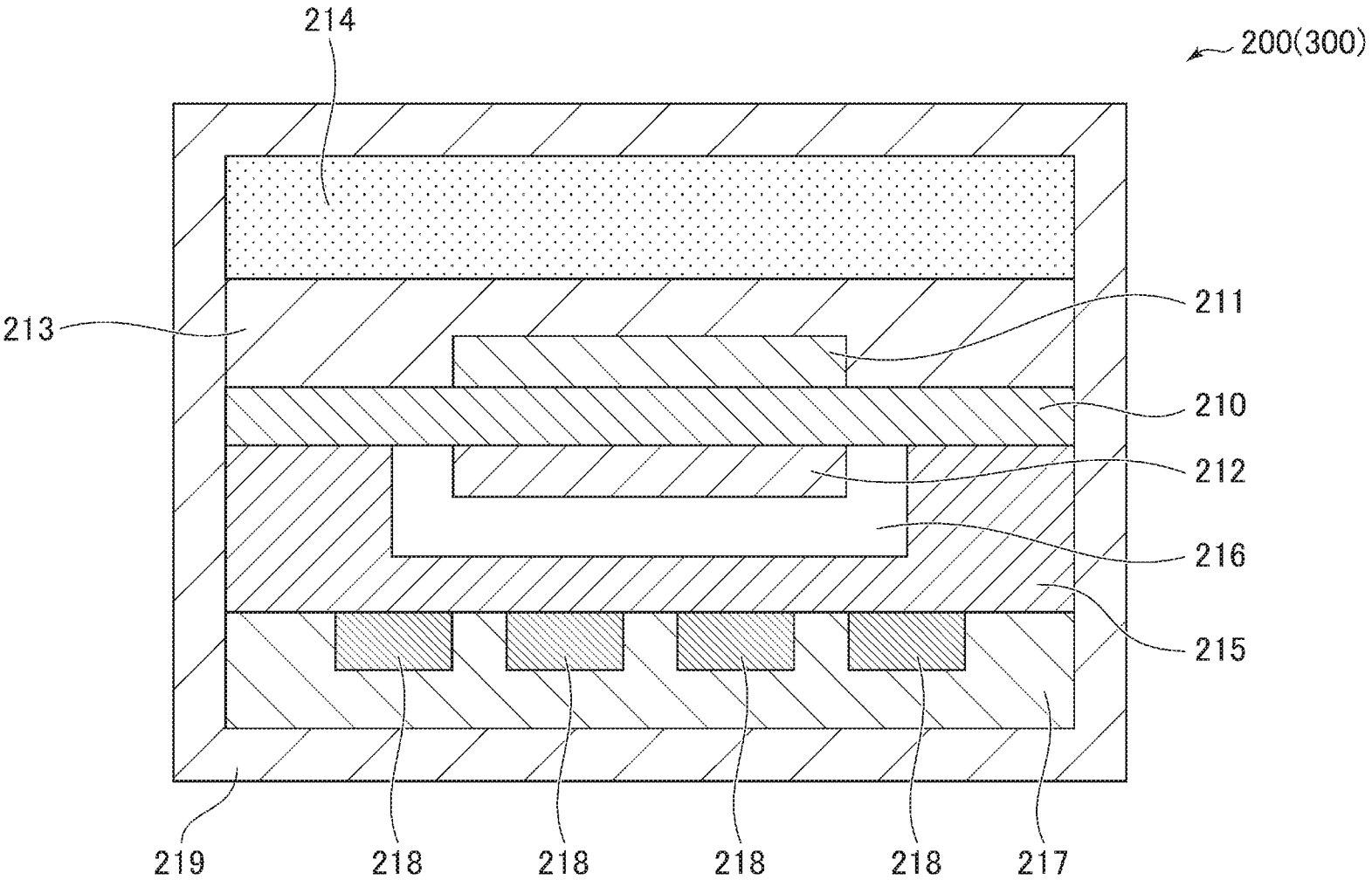

Next, the following describes an example of the structure of the upstream sensor 200 with reference to FIG. 2. Note that, because the structure of the downstream sensor 300 is substantially the same as that of the upstream sensor 200, the following describes only the structure of the upstream sensor 200 while omitting descriptions of the structure of the downstream sensor 300.

The upstream sensor 200 is designed as a plate-type air-fuel ratio sensor having one cell structure. FIG. 2 illustrates a cross sectional view of a part of the upstream sensor 200, which is arranged in the exhaust passage 13.

The upstream sensor 200 includes a solid electrolyte 210, an working electrode 211, a reference electrode 212 and a heater 218.

The solid electrolyte 210 is made of partially stabilized zirconia formed to have a sheet-like shape. The solid electrolyte 210 becomes active to have oxygen ion electrical conductivity when having a predetermined activation temperature.

That is, the upstream sensor 200 is configured to measure the air-fuel ratio of the exhaust gas utilizing the characteristic of the solid electrolyte 210; the characteristic of the solid electrolyte 210 represents that the amount of oxygen ion passing through the active solid electrolyte 210 varies depending on the air-fuel ratio, i.e. oxygen concentration, of the exhaust gas.

The working electrode 211 is comprised of a layer formed on the surface of a first side (upper side in FIG. 2) of the solid electrolyte 210. Specifically, the working electrode 211 is comprised of a porous layer which is made of platinum or the like. This enables the working electrode 211 to have both of electrical conductivity and permeability.

The upstream sensor 200 also includes a gas transmission layer 213 and a gas shielding layer 214. The gas transmission layer 213 is mounted on the surface of the first side of the solid electrolyte 210 to cover around the working electrode 211. The gas transmission layer 213 is made of, for example, anti-heat ceramics having porosity, covering entirely the surface of the first side of the solid electrolyte 210 on which the working electrode 211 is mounted. The gas transmission layer 213 has opposite first and second sides, the surface of the first side of which is mounted on the solid electrolyte 210, the surface of the second side of which is covered with the gas shielding layer 214. The gas shielding layer 214 is comprised of a layer made of anti-heat ceramic having porosity, which is similar to the transmission layer 213. The porosity of the gas shielding layer 214 is smaller than the porosity of the gas transmission layer 213. This enables the exhaust gas passing through the exhaust passage 13 to enter the inside of the gas transmission layer 213 from the other sides of the gas transmission layer 213 except for the surface covered with the gas shielding layer 214, and thereafter to reach the solid electrolyte 210 via the working electrode 211.

The reference electrode 212 is comprised of a layer mounted on the surface of the second side of the solid electrolyte 210 (lower side in FIG. 2). Similar to the working electrode 211, the reference electrode 212 is comprised of a layer having porosity made of platinum or the like. This results in the reference electrode 212 having both electrical conductivity and permeability.

The upstream sensor 200 further includes a duct 215 and an air passage 216. The surface of the second side of the solid electrolyte 210 is covered with the duct 215. The duct 215 is comprised of a layer made of, for example, alumina and is formed by, for example, an injection molding.

The air passage 216 is comprised of a space defined by the duct 215 and the reference electrode 212. That is, the duct 215 surrounds the air passage 216 to thereby isolate the air passage 216 from the exhaust passage 13. The outside air is introduced into the air passage 216.

That is, the solid electrolyte 210 is configured such that the first side is exposed to the exhaust gas passing through the exhaust passage 13, and the second side is exposed to the outside air. This causes transportation of oxygen ions to occur due to the difference in oxygen concentrations between the first and second sides of the solid electrolyte 210.

The heater 218 is energized by the control device 100 to generate heat, thereby maintaining the solid electrolyte 210 having the activation temperature. The heater 218 according to the first embodiment is made of the mixture of platinum and alumina. The control device 100 is configured to adjust the amount of electrical power supplied to the heater 218, that is, the heat quantity of the heater 218.

The upstream sensor 200 includes an insulation layer 217 composed of, for example, alumina having high purity, and arranged to cover around the heater 218.

Additionally, the upstream sensor 200 includes a protective layer 219 covering the outer periphery of the assembly of the components 210 to 218 set forth above. The protection layer 219 prevents the gas transmission layer 213 from being clogged due to condensed components of the exhaust gas. The protection layer 210 is for example formed of a high surface area alumina by using a dip method or a plasma spraying method. In view of preventing the clogging of the gas transmission layer 213, only the sides of the gas transmission layer 213 may be covered with the protection layer 219. However, in view of improving moisture retaining properties of the assembly, the protective layer 219 covers entirely the assembly in addition to the sides of the gas transmission layer 213.

The upstream sensor 200 includes an unillustrated cover made of, for example, stainless. The cover covers the outer periphery of the protection layer 219 with a plurality of through holes formed therethrough. The through holes enable the exhaust to flow therethrough to enter the inside of the cover.

The control device 100 applies a predetermined voltage between the working electrode 211 and the reference electrode 212 of the upstream sensor 200 to thereby cause the upstream sensor 200 to measure the air-fuel ratio of the exhaust gas. The voltage application causes a transportation of oxygen ions to occur due to the difference in oxygen concentrations between the first side of the solid electrolyte 210 closer to the working electrode 211 and the second side of the solid electrolyte 210 closer to the reference electrode 212, i.e. the difference between the oxygen concentrations of the exhaust gas and the oxygen concentrations of the outside air, i.e. atmospheric air.

This results in an output signal, i.e. an output current, flowing between the working electrode 211 and the reference electrode 212 while the amount of the output current is substantially proportional to the air-fuel ratio of the exhaust gas.

As described above, each of the upstream sensor 200 and the downstream sensor 300 is configured to change its output current to be proportional to the air-fuel ratio of the exhaust gas. The control device 100 is configured to acquire the air-fuel ratio of the exhaust gas flowing through the exhaust passage 13 based on the magnitude of the output current, whose unit is, for example, milliamperes, from, for example, the upstream sensor 200.

$O_2$ sensors are known to measure the air-fuel ratio in addition to the air-fuel ratio sensors configured described above. Such an $O_2$ sensor is configured to abruptly change its output signal, i.e. output voltage signal, when the air-fuel ratio of exhaust gas is located within a range including a theoretical air-fuel ratio, i.e. a stoichiometric air-fuel ratio, and output the output signal having a constant value when the air-fuel ratio of the exhaust gas is located outside the range.

Figure 3A:
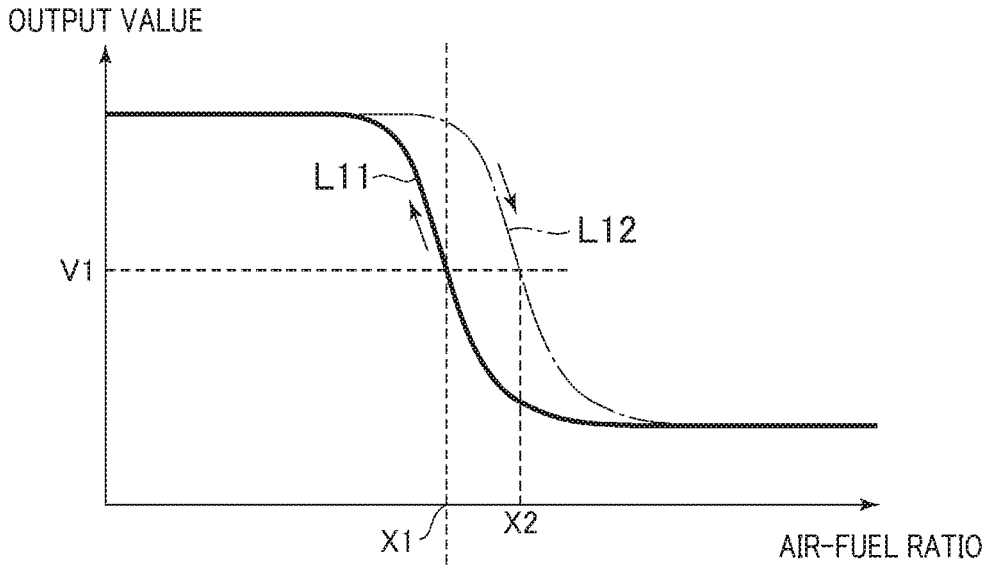
FIG. 3A is a graph schematically illustrates a relationship between values of an output signal an $O_2$ sensor and corresponding values of an air-fuel ratio.

FIG. 3A schematically illustrates an example of values of the output signal, i.e. output voltage signal, from an $O_2$ sensor in a graph whose horizontal axis represents the air-fuel ratio, and whose vertical axis represents the output voltage signal.

The $O_2$ sensor has an output characteristic exhibiting hysteresis. In FIG. 3A, a solid line L11 shows how the output signal changes when the air-fuel ratio decreases to shift from a lean side to a rich side near a theoretical air-fuel ratio. A dot-and-dash line L12 shows how the output signal changes when the air-fuel ratio increases to shift from the rich side to the lean side near the theoretical air-fuel ratio.

FIG. 3A shows that the line L11 and the line L12 are not identical to each other, so that, when the output voltage signal has a voltage V1, the air-fuel ratio can take one of a value X1 along the line L11 and a value X2 along the line L12. There may therefore be a possibility of the control device 100 erroneously acquiring the value X2 of the air-fuel ratio although the actual air-fuel ratio is the value X1. This may cause the control device 100 to erroneously correct a target air-fuel ratio described later.

Figure 3B:
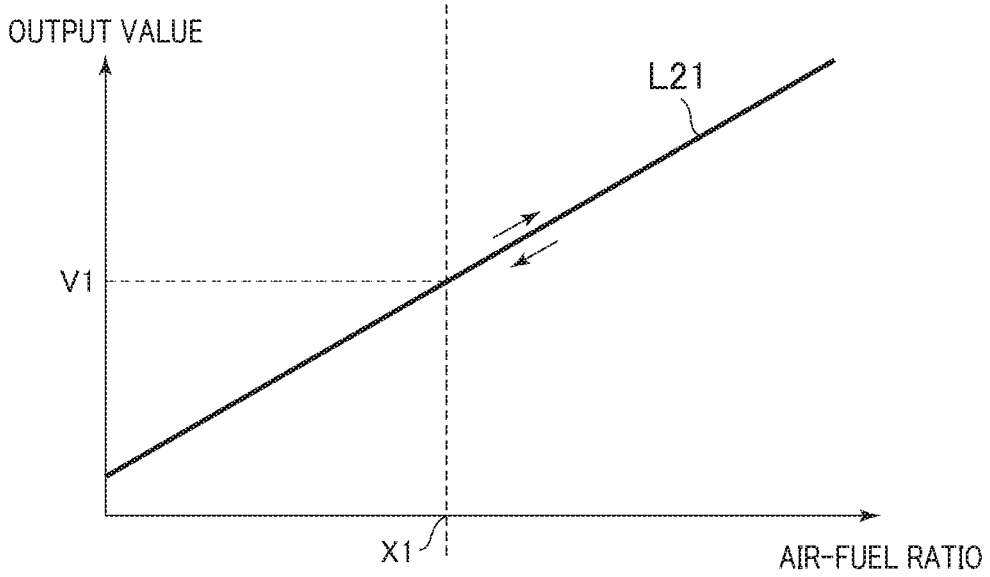
FIG. 3B is a graph schematically illustrates a relationship between values of each of upstream and downstream sensors illustrated in FIG. 1 and corresponding values of an air-fuel ratio.

In contrast, FIG. 3B schematically illustrates an example of values of the output signal from each of the upstream and downstream sensors 200 and 300 in a graph whose horizontal axis represents the air-fuel ratio, and whose vertical axis represents the output signal.

As illustrated in FIG. 3B, a solid line L21 represents an example of the relationship between the values of the output signal output from each of the upstream and downstream sensors 200 and 300 and corresponding values of the air-fuel ratio of the exhaust gas. That is, the solid line L21 has a constant gradient within a wider range of the air-fuel ratio including the theoretical air-fuel ratio.

Additionally, the solid line L21 commonly shows both how the output signal changes when the air-fuel ratio decreases to shift from the lean side to the rich side near the theoretical air-fuel ratio, and how the output signal changes when the air-fuel ratio increases to shift from the rich side to the lean side near the theoretical air-fuel ratio. That is, the output characteristic of each of the upstream and downstream sensors 200 and 300 has no hysteresis. This therefore enables each of the upstream and downstream sensors 200 and 300 to always output the value V1 when the air-fuel ratio is a value X1 independently of the change direction of the air-fuel ratio from lean side to the rich side or from the rich side to the lean side as illustrated in FIG. 3B.

As described above, each of the upstream and downstream sensors 200 and 300 is configured as a linear sensor that changes, depending on change of the air-fuel ratio, its output signal with a constant gradient. This configuration of each of the upstream and downstream sensors 200 and 300 enables the control device 100 to obtain the air-fuel ratio of the exhaust gas with higher accuracy, and also correct the target air-fuel ratio, which is described below more appropriately. It is preferable that air-fuel ratio sensors, each of which has one-cell structure and an output characteristic with no hysteresis in principle, is used as the respective upstream and downstream sensors 200 and 300.

In particular, each of the upstream and downstream sensors 200 and 300 is configured to output the output current with the magnitude of zero when the air-fuel ratio of the exhaust gas is identical to the theoretical air-fuel ratio.

Next, the following describes an example of the structure of the control device 100 with reference to FIG. 1.

The control device 100 is designed as, for example, a computer system essentially including, for example, a CPU, i.e. a processor, 100*a*, a memory 100*b* comprised of, for example, a RAM and a ROM, and a peripheral circuit 100*c*; the ROM is an example of a non-transitory storage medium. At least part of all functions provided by the control device 100 can be implemented by at least one processor; the at least one processor can be comprised of (1) The combination of at least one programmable processing unit, i.e. at least one programmable logic circuit, and at least one memory (2) At least one hardwired logic circuit (3) At least one hardwired-logic and programmable-logic hybrid circuit Specifically, the control device 100 is configured such that the processor 100*a* performs instructions of programs stored in the memory 100*b*, thus implementing the following functional components associated with control of the engine 11. The control device 100 can also be configured such that the at least one special-purpose electronic circuit implements the following functional components associated with control of the engine 11. The control device 100 can be configured to perform both the software tasks and the hardware tasks.

The control device 100 functionally includes a control unit 110, an updating unit 120, and a partition changing unit 130, and also includes a learning map 140 stored in, for example, the memory 100*b*.

The control unit 110 is configured to control the engine 11. Specifically, the control unit 110 is configured to adjust at least one of the quantity of fuel to be sprayed from the injector 12 into the engine 11, and each injection timing at which the injector 12 sprays the controlled quantity of fuel, thus matching the actual air-fuel ratio measured by, for example, the upstream sensor 200 with the target air-fuel ratio. The target air-fuel ratio can be set to a value at which the upstream catalytic converter 14 has the highest exhaust-gas cleaning performance. As described later, the target air-fuel ratio serves as at least one control parameter used by the control unit 110 for controlling the engine 11. The following describes that the control unit 110 uses the air-fuel ratio to thereby control the engine 11. In other words, the control unit 110 serves as a component for controlling the engine 11 using the at least one control parameter.

The learning map 140 is comprised of information indicative of, for example, a correspondence relationship between (1) Each operating condition of the engine 11, which represents the corresponding operating situation of the vehicle MV (2) Values of the at least one control parameter suitable for the corresponding operating condition of the engine 11; the values of the at least one control parameter should be set for the corresponding operating condition of the engine 11

Figure 4:
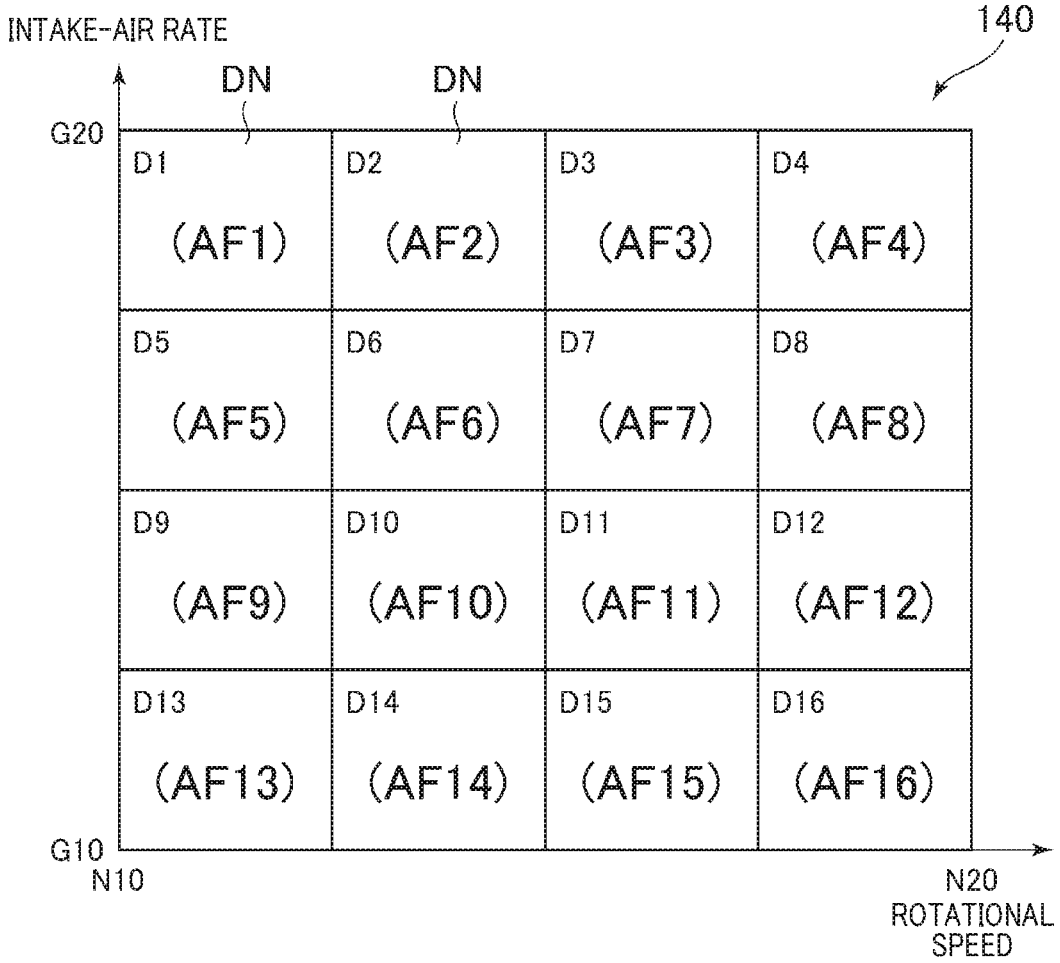
FIG. 4 is a diagram schematically illustrating an example of a learning map according to the first embodiment.

FIG. 4 schematically illustrates an example of the learning map 140 according to the first embodiment.

Specifically, each of the operating conditions of the engine 11 according to the first embodiment is represented as a pair of a corresponding value of the rotational speed of the engine 11 and a corresponding value of the intake-air rate for the engine 11.

When the operating conditions of the engine 11 are shown in a graph whose horizontal axis represents the rotational speed of the engine 11, which will be referred to as an engine rotational speed, and whose vertical axis represents the intake-air rate, each of the operating conditions represents a coordinate point having a pair of a corresponding value of the engine rotational speed and a corresponding value of the intake-air rate (see FIG. 4).

The operating conditions, i.e, the respective coordinate points, of the engine 11 are grouped into a plurality of operating regions DN, and the operating regions DN constitute the learning map 140 according to the first embodiment.

Specifically, as illustrated in FIG. 4, values of the engine rotational speed from a value N10 to a value N20 inclusive are partitioned into four regions, and values of the intake-air rate from a value G10 to a value G20 inclusive are also partitioned into four regions. This results in that the operating conditions, i.e, the respective coordinate points, being categorized into (4×4)=16 operating regions DN from a first operating region D1 to a sixteenth operating region D16. That is, the learning map 140 is partitioned into the first to sixteenth operating regions D1 to D16.

As illustrated in FIG. 4, the first to fourth operating regions D1 to D4 are arranged from the lower side of the engine rotational speed to the higher side thereof, and the first, fifth, ninth, and thirteenth operating regions D1, D5, D9, and D13 are arranged from the larger side of the intake-air rate to the smaller side of the intake-air rate.

Additionally, the learning map 140 individually stores values of the target air-fuel ratio, i.e. the at least one control parameter, correlating with the respective operating regions D1 to D16. For example, a value AF1 is stored as the target air-fuel ratio of the first operating region D1 to correlate with the first operating region D1, and a value AF11 is stored as the target air-fuel ratio of the eleventh operating region D11 to correlate with the eleventh operating region D11.

That is, the control device 100 is configured to set the value AF1 as the target air-fuel ratio when the engine 11 becomes one of the operating conditions categorized in the first operating region D1.

As described above, the learning map 140 is previously generated as a two-dimensional map comprised of values of the engine rotational speed and corresponding values of the intake-air rate, but the learning map 140 can be previously generated as an M-dimensional map comprised of values of M operating condition parameters of the engine 11 where M is an integer equal to or more than 3, or as a one-dimensional map comprised of values of a single operating condition parameter of the engine 11.

The updating unit 120 is configured to learn the at least one control parameter, such as the target air-fuel ratio, for each of the operating regions D1 to D16 while the operating condition of the engine 11 is in the corresponding one of the operating conditions D1 to D16 such that a value of the air-fuel ratio calculated by the downstream sensor 300 is closer to the theoretical air-fuel ratio to thereby obtain a learned value of the at least one control parameter, such as the target air-fuel ratio, for each of the operating regions D1 to D16.

Then, the updating unit 120 is configured to update the previously stored value of each of the operating regions D1 to D16 of the at least one control parameter in the learning map 140 to the corresponding learned value obtained for the corresponding one of the operating regions D1 to D16.

Figure 5A:
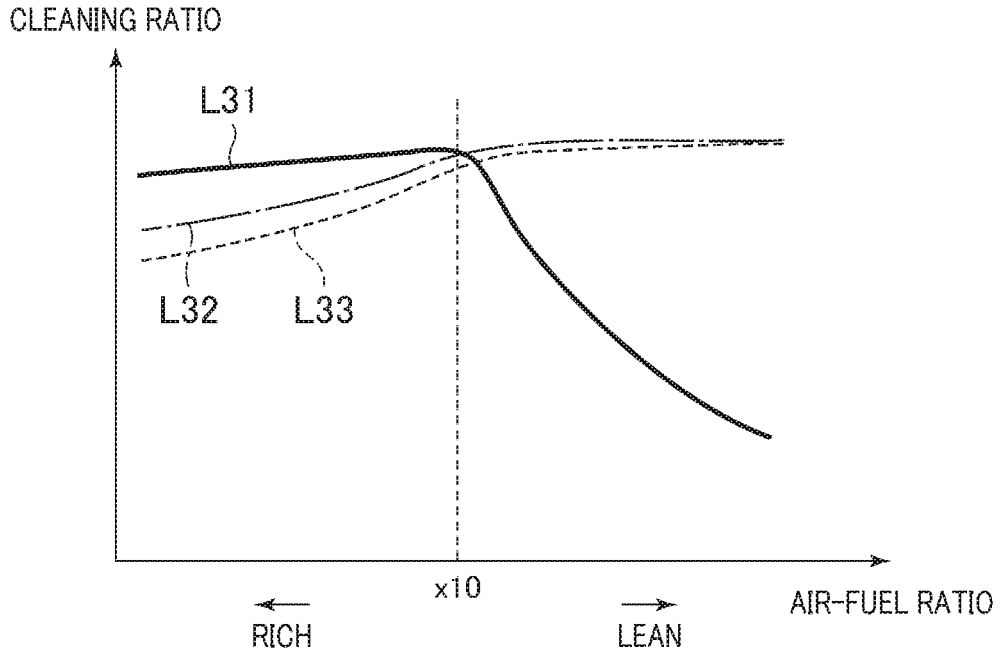
FIG. 5A is a graph schematically illustrating correspondence relationships between values of the air-fuel ratio and values of each of first to third cleaning ratios for exhaust gas by the upstream catalytic converter.
Figure 5B:
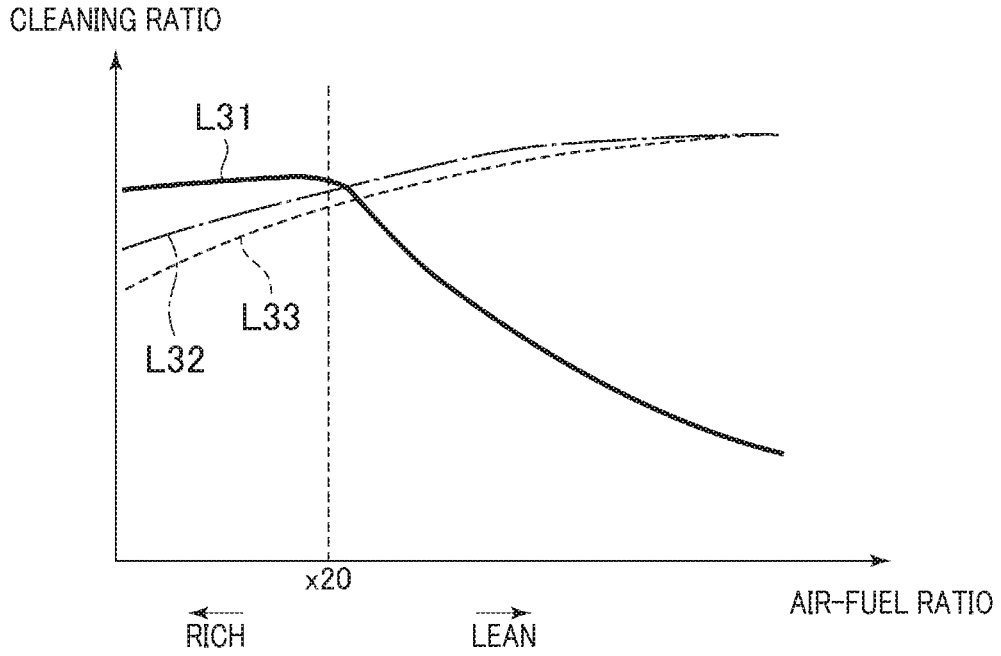
FIG. 5B is a graph schematically illustrating correspondence relationships between values of the air-fuel ratio and values of each of the first to third cleaning ratios for the exhaust gas by the upstream catalytic converter.

The following describes why the learning map 140 should be updated with reference to FIGS. 5A and 5B.

FIG. 5A is a graph schematically illustrating correspondence relationships between values of the air-fuel ratio on the horizontal axis and values of each of first to third cleaning ratios for the exhaust gas by the upstream catalytic converter 14 while the operating condition of the engine 11 becomes a first specific operating condition. A solid curve L31 represents the first cleaning ratio for nitrogen oxides contained in the exhaust gas, and a dot-and-dash line L32 represents the second cleaning ratio for carbon monoxide contained in the exhaust gas, and a dashed curve L33 represents the third cleaning ratio for hydrocarbons contained in the exhaust gas.

FIG. 5A shows that the first to third cleaning ratios L31, L32, and L33 for respective nitrogen oxides, carbon monoxide, and hydrocarbons change depending on the air-fuel ratio. In addition, the changed curves of the first to third cleaning ratios L31, L32, and L33 are different from each other. FIG. 5A shows that each of the first to third cleaning ratios L31, L32, and L33 takes its highest value when the air-fuel ratio is set to a value x10. This results in the target air-fuel ratio is set to the value x10 when the operating condition of the engine 11 is the first specific operating condition.

FIG. 5B is a graph schematically illustrating correspondence relationships between values of the air-fuel ratio on the horizontal axis and values of each of the first to third cleaning ratios for the exhaust gas by the upstream catalytic converter 14 while the operating condition of the engine 11 becomes a second specific operating condition. The solid curve L31 represents the first cleaning ratio for nitrogen oxides contained in the exhaust gas, and the dot-and-dash line L32 represents the second cleaning ratio for carbon monoxide contained in the exhaust gas, and the dashed curve L33 represents the third cleaning ratio for hydrocarbons contained in the exhaust gas.

As comparison between the graph of FIG. 5A and the graph of FIG. 5B, the shape of each of the first to third cleaning ratios L31, L32, and L33 changes as the operating condition of the engine 11 is changed. FIG. 5B shows that each of the first to third cleaning ratios L31, L32, and L33 takes its highest value when the air-fuel ratio is set to a value x20, that is richer than the value x10. This results in the target air-fuel ratio is set to the value x20 when the operating condition of the engine 11 is the second specific operating condition.

This makes clear that, when the engine 11 is changed from a first operating condition to a second operating condition, a first value of the target air-fuel ratio, i.e. the at least one control parameter, that should be set for the first operating condition, is changed to a second value that should be set for the second operating condition.

For this reason, the learning map 140 stores the values of the target air-fuel ratio such that they correlate with the corresponding respective operating regions DN.

Unfortunately, the value of the at least one control parameter, which has been set to be suitable for a selected operating condition of the engine 11, may be not necessarily identical with the value of the same control parameter, which has been set to be suitable for the same operating condition of the engine.

For example, the value of the at least one control parameter, which has been set to be suitable for a selected operating condition of the engine installed in a first vehicle used as the vehicle MV, may be different from the value the same control parameter, which has been set to be suitable for the same operating condition of the engine installed in a second vehicle used as the vehicle MV, due to individual differences between the first and second vehicles.

As another example, the value of the at least one control parameter, which has been set to be suitable for a selected operating condition of the engine, may be changed to another value depending on, for example, change in state of at least one of the catalysts 14 and 15.

That is, each of the first to third cleaning ratios of the upstream catalytic converter 14 is changed from the shape illustrated in FIG. 5A to the different shape illustrated in FIG. 5B even if the operating condition of the engine 11 is unchanged, so that an optimum value of the air-fuel ratio is changed from the value x10 to the value x20.

For addressing such an issue, the updating unit 120 of the first embodiment is configured to update the values AF1 to AF16 of the target air-fuel ratio stored for the respective operating regions DN (D1 to D16) of the learning map 140. How the updating unit 120 updates the values AF1 to AF16 of the target air-fuel ratio stored for the respective operating regions DN (D1 to D16) of the learning map 140 will be described later.

The partition changing unit 130 is configured to change how to partition the learning map 140. That is, the number of partitions, i.e. divisions, of the learning map 140 is not fixed to 16 as illustrated in FIG. 4, and therefore the number of partitions of the learning map 140 can be changed by the division changing unit 130.

For example, the partition changing unit 130 is configured to perform a task of increasing the number of partitions of the learning map 140 to thereby make narrower at least some of the operating regions. This task will be referred to as a partition-number increasing task.

Figure 6A:
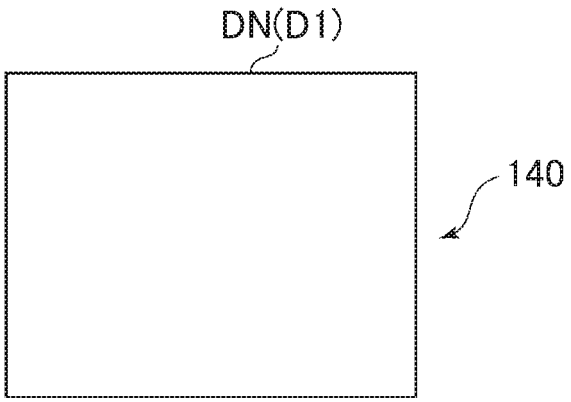
FIGS. 6A to 6C are a joint diagram schematically illustrating how the number of partitions of a learning map is changed by a partition-number increasing task according to the first embodiment.
Figure 6B:
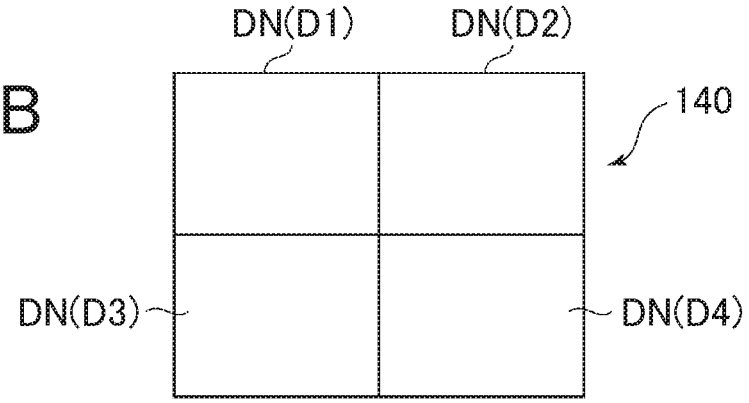
Figure 6C:
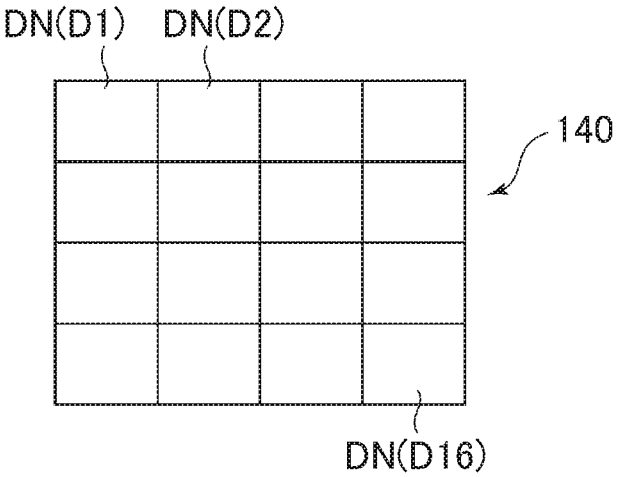

FIGS. 6A to 6C illustrate how the number of partitions of the learning map 140 is changed by the partition-number increasing task.

Specifically, the partition-number increasing task causes the learning map 140 whose partition number is 1 (see FIG. 6A) to be changed to the learning map 140 whose partition number is changed from 1 to 4 (see FIG. 6B). Additionally, the partition-number increasing task causes the learning map 140 whose partition number is 4 (see FIG. 6B) to be changed to the learning map 140 whose partition number is changed from 4 to 16 (see FIG. 6C).

That is, the operating conditions, i.e, the respective coordinate points, of the engine 11, which are grouped into a single operating region DN (see FIG. 6A), are re-grouped into four operating regions DN (see FIG. 6B), and thereafter, re-grouped into sixteen operating regions DN (see FIG. 6C).

As another example, the partition changing unit 130 is configured to perform a task of decreasing the number of partitions of the learning map 140 to thereby make wider at least some of the operating regions. This task will be referred to as a partition-number decreasing task. The partition-number increasing and decreasing tasks are collectively referred to as a partition-number changing task.

FIGS. 6C to 6A illustrate how the number of partitions of the learning map 140 is changed by the partition-number decreasing task.

Specifically, the partition-number decreasing task causes the learning map 140 whose partition number is 16 (see FIG. 6C) to be changed to the learning map 140 whose partition number is changed from 16 to 4 (see FIG. 6B). Additionally, the partition-number decreasing task causes the learning map 140 whose partition number is 4 (see FIG. 6B) to be changed to the learning map 140 whose partition number is changed from 4 to 1 (see FIG. 6A).

That is, the operating conditions, i.e, the respective coordinate points, of the engine 11, which are grouped into sixteen operating regions DN (see FIG. 6C), are re-grouped into four operating regions DN (see FIG. 6B), and thereafter, re-grouped into a single operating region DN (see FIG. 6A).

Benefits achieved by the partition-number increasing task or the partition-number decreasing task will be described later.

Figure 7:
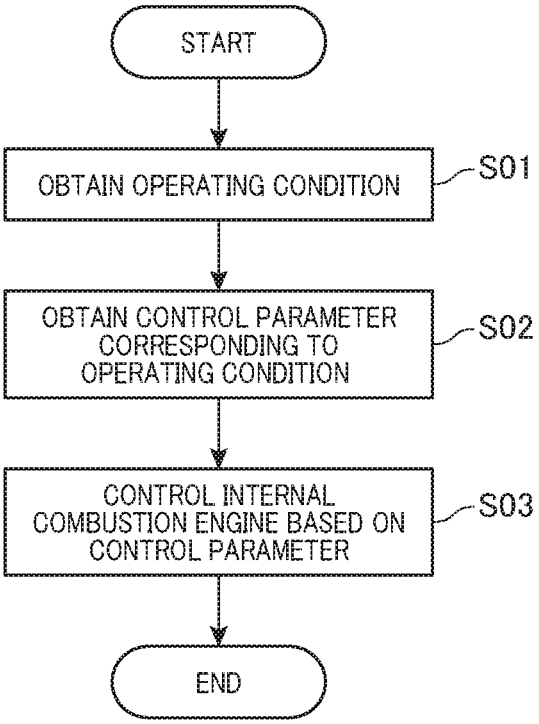
FIG. 7 is a flowchart schematically illustrating an engine control routine carried out by the control device.

Next, the following describes an engine control routine carried out by the control unit 110 of the control device 100, i.e. its processor 100*a*, every predetermined control period with reference to FIG. 7.

In step S01, the control unit 110 obtains values of the operating condition parameters from the various sensors SS at a current time. Specifically, the control unit 110 obtains the intake-air rate from the intake airflow sensor 16, and the engine rotational speed from the rotational speed sensor 17, thus determining a present value of the operating condition of the engine 11 in step S01.

Next, the control unit 110 obtains a value of the at least one control parameter corresponding to the present value of the operating condition of the engine 11 in step S02. Specifically, the control unit 110 refers to the learning map 140, and extracts, from the learning map 140, the value of the at least one control parameter stored in a selected one of the operating regions DN in step S02; the selected one of the operating regions DN includes the present value of the operating condition of the engine 11.

For example, if the present value of the operating condition of the engine 11 is included in the first operating region D1 of the learning map 140, the control unit 110 extracts, from the first operating region D1, the value AF1 of the target air-fuel ratio as the at least one control parameter.

Next, the control unit 110 controls the engine 11 based on the extracted value of the at least one control parameter in step S03. Specifically, the control unit 110 adjusts, for example, the amount of fuel to be sprayed from the injector 12 to thereby match the air-fuel ratio measured by the upstream sensor 200 with the value AF1 of the target air-fuel ratio as the at least one control parameter. Thereafter, the control unit 110 terminates the engine control routine.

Figure 8:
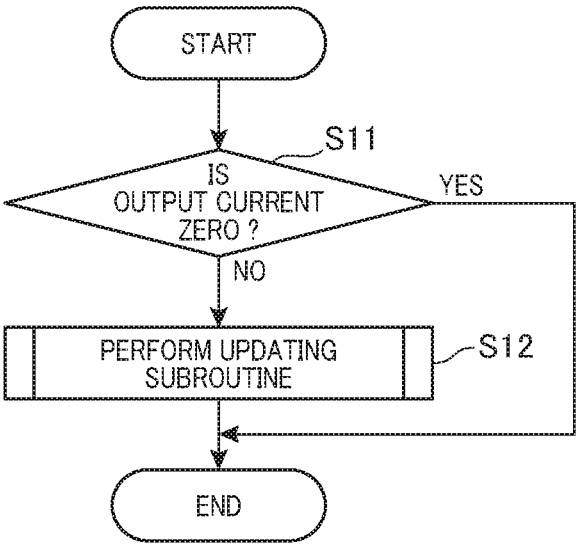
FIG. 8 is a flowchart schematically illustrating an updating routine carried out by the control device.

Next, the following describes an updating routine carried out by the updating unit 120 of the control device 100, i.e. its processor 100*a*, every predetermined control period with reference to FIG. 8. That is, the updating routine is for example carried out in parallel with the engine control routine.

In step S11, the updating unit 120 determines whether the air-fuel ratio measured by the downstream sensor 300 is the theoretical air-fuel ratio, i.e. the magnitude of the output current from the downstream sensor 300 is zero, i.e. 0 milliamperes.

Upon determining that the output current from the downstream sensor 300 is zero (YES in step S11), the updating unit 120 determines that the air-fuel ratio of the exhaust gas having passed through the upstream catalytic converter 14 becomes the highest cleaning point (see the value x10 in FIG. 5A for example), thus determining that the upstream catalytic converter 14 properly cleans the exhaust gas. Then, the updating unit 120 terminates the updating routine while skipping the operation in step S12.

Otherwise, upon determining that the output current from the downstream sensor 300 is not zero (NO in step S11), the updating unit 120 determines that the air-fuel ratio of the exhaust gas having passed through the upstream catalytic converter 14 has shifted from the highest cleaning point, so that nitrogen oxides or other similar materials are leaked out toward the downstream of the upstream catalytic converter 14. That is, the updating unit 120 determines that the value of the at least one control parameter stored in the selected one of the operating regions DN, which includes the present value of the operating condition of the engine 11, has been improper.

Thus, the updating unit 120 determines that there is a need to update the improper value stored in the selected one of the operating regions DN into a proper value, thus performing an updating subroutine in step S12. The updating subroutine is programmed to (1) Correct the target air-fuel ratio included in the selected one of the operating regions DN to thereby cause the air-fuel ratio obtained from the exhaust gas having passed through the upstream catalytic converter 14 to become the highest cleaning point (2) Update the present target air-fuel ratio included in the selected one of the operating regions DN to the corrected target air-fuel ratio Next, the following describes the updating subroutine with reference to FIG. 9.

In step S21 of the updating subroutine, the updating unit 120 determines whether a warmup operation of the engine 11 has been completed. For example, a sensor included in the sensors SS measures the temperature of a coolant circulating between the engine 11 and an unillustrated radiator, and sends the measured coolant temperature to the control device 100. The updating unit 120 determines whether the coolant temperature has increased up to a predetermined temperature, for example, 65° C., and determines that the warmup operation of the engine 11 has been completed upon determining that the coolant temperature has increased up to the predetermined temperature (YES in step S21). Otherwise, upon determining that the coolant temperature has not increased up to the predetermined temperature (NO in step S21), the updating unit 120 repeats the determination in step S21.

The updating subroutine proceeds to step S22 when the determination in step S21 is affirmative.

In step S22, the updating unit 120 determines whether the travelling condition of the vehicle MV is stable. For example, the updating unit 120 calculates the speed of the vehicle MV based on the RPM of the engine 11 measured by the rotational speed sensor 17, and monitors the speed of the vehicle MV to thereby determine whether the speed of the vehicle MV is substantially constant so that the variations in the speed of the vehicle MV are within a predetermined range of, for example, ±5 km/h.

Upon determining that the speed of the vehicle MV is substantially constant so that the variations in the speed of the vehicle MV are within the predetermined range, the updating unit 120 determines that the travelling condition of the vehicle MV is stable (YES in step S22). Then, the updating subroutine proceeds to step S23. Otherwise, upon determining that the speed of the vehicle MV is not substantially constant so that the variations in the speed of the vehicle MV are outside the predetermined range, the updating unit 120 determines that the travelling condition of the vehicle MV is unstable (NO in step S22), and repeats the determination in step S22.

In step S23, the updating unit 120 starts sampling the measurement value measured by the downstream sensor 300. For example, the updating unit 120 is able to sample the measurement value of the air-fuel ratio or the measurement value of the output current from the downstream sensor 300.

The updating unit 120 of the first embodiment samples the measurement value of the output current from the downstream sensor 300 every 32 milliseconds, and stores the sampled measurement values, i.e. sampled current values, in the memory 100*b*.

In step S24, the updating unit 120 determines whether the number of sampled measurement values has reached a predetermined target number of, for example, 200. Upon determining that the number of sampled measurement values has not reached the predetermined target number (NO in step S24), the updating unit 120 repeats the determination in step S24. Otherwise, upon determining that the number of sampled measurement values has reached the predetermined target number (YES in step S24), the updating unit 120 terminates the sampling of the measurement value measured by the downstream sensor 300 in step S25.

Following the operation in step S25, the updating unit 120 averages the sampled measurement values to thereby calculate an average value in step S26.

Next, the updating unit 120 calculates a correction that should be added to or subtracted from the target air-fuel ratio previously stored in the selected one of the operating regions DN in step S27. Specifically, the updating unit 120 subtracts, from the average value, the value of the output current, i.e. 0 milliamperes, corresponding to the highest cleaning point of the air-fuel ratio by the upstream catalytic converter 14. Then, the updating unit 120 calculates an absolute value of the subtraction result, and converts the absolute value, i.e. current value, into a corresponding value of the air-fuel ratio using, for example, a predetermined conversion table between values of the air-fuel ratio and corresponding values of the output current from the downstream sensor 300. This obtains the converted value of the air-fuel ratio as the correction.

Next, the updating unit 120 adds the correction to or subtracts the correction from the target air-fuel ratio previously stored in the selected one of the operating regions DN, which includes the present value of the operating condition of the engine 11 in step S28.

Specifically, in step S28, the updating unit 120 subtracts the correction from the target air-fuel ratio previously stored in the selected one of the operating regions DN when the average value calculated in step S26 is leaner than the theoretical air-fuel ratio, i.e. is positively shifted relative to the theoretical air-fuel ratio. That is, the updating unit 120 corrects the target air-fuel ratio previously stored in the selected one of the operating regions DN to be richer.

In contrast, in step S28, the updating unit 120 adds the correction to the target air-fuel ratio previously stored in the selected one of the operating regions DN when the average value calculated in step S26 is richer than the theoretical air-fuel ratio, i.e. is negatively shifted relative to the theoretical air-fuel ratio. That is, the updating unit 120 corrects the target air-fuel ratio previously stored in the selected one of the operating regions DN to be leaner.

Following the operation in step S28, the updating unit 120 stores the corrected target air-fuel ratio obtained by the operation in step S28 into the selected one of the operating regions DN of the learning map 140 as a new target air-fuel ratio in step S29. Specifically, the updating unit 120 overwrites the corrected target air-fuel ratio, i.e. the new target air-fuel ratio, into the selected one of the operating regions DN of the learning map 140, which includes the present value of the operating condition of the engine 11, thus updating the target air-fuel ratio previously stored in the selected one of the operating regions DN to the new target air-fuel ratio in step S29.

This therefore enables the value of the at least one control parameter, i.e. the target air-fuel ratio, previously stored in the selected one of the operating regions DN to be updated to the new value of the at least one control parameter suitable for the present operating condition of the vehicle MV.

The above updating method of the target air-fuel ratio is one of other various updating methods. That is, the updating unit 120 can be configured to update the value of the at least one control parameter stored in the selected one of the operating regions DN of the learning map 140 to a new value using a selected one of the other updating methods.

The following describes how the learning map 140 is changed based on the partition changing task of the partition changing unit 130, and also describes benefits achieved by the partition changing task of the partition changing unit 130 with reference to FIGS. 10A to 10D.

Figure 10A:
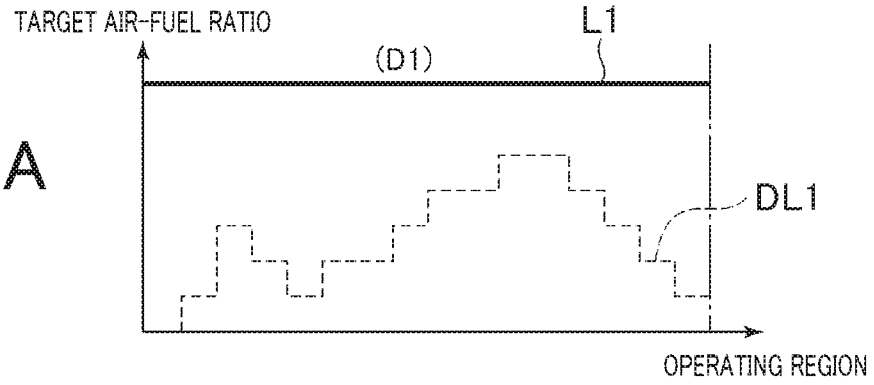
FIGS. 10A to 10D are a joint graphic diagram schematically illustrating how the learning map is changed based on a partition changing task of the control device according to the first embodiment.
Figure 10B:
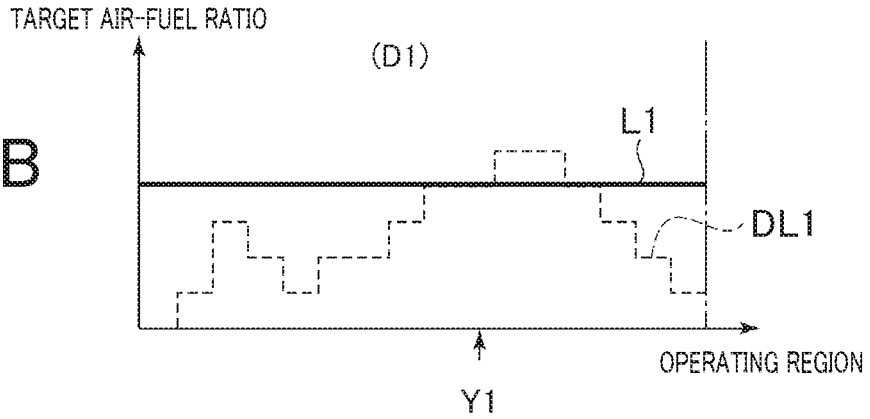
Figure 10C:
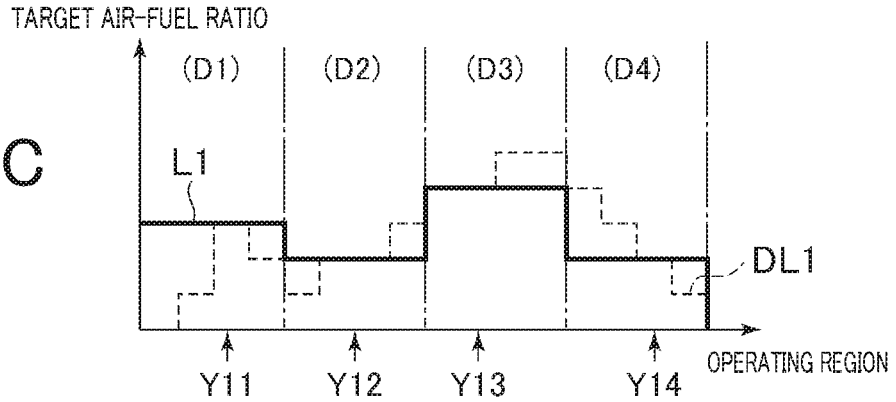
Figure 10D:
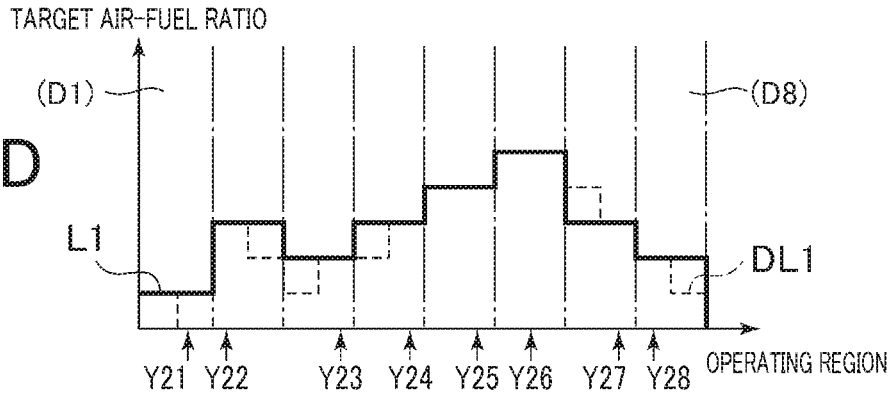

The horizontal axis of each of FIGS. 10A and 10B represents the single operating region DN, i.e. D1 (see FIG. 6A), one-dimensionally developed in line, and the horizontal axis of FIG. 10C represents the four operating regions DN, i.e. D1 to D4 (see FIG. 6B), one-dimensionally developed in line. The horizontal line of FIG. 10D represents that the eight operating regions DN, i.e. D1 to D8, one-dimensionally developed in line. In other words, the horizontal axis of each of FIGS. 10A to 10D also represents that the operating conditions that the engine 11 can take are one-dimensionally expressed.

The vertical axis of each of FIGS. 10A and 10B represents values of the target air-fuel ratio included in the operating region DN (D1), and the vertical axis of FIG. 10C represents values of the target air-fuel ratio included in the respective operating regions DN (D1 to D4). The vertical axis of FIG. 10D represents values of the target air-fuel ratio included in the respective operating regions DN (D1 to D8).

In each of FIGS. 10A and 10B, a dot-and-dash line represents one boundary in the operating region DN (D1), and, in FIG. 10C, dot-and-dash lines represent four boundaries among the operating regions DN (D1 to D4). In FIG. 10D, dot-and-dash lines represent eight boundaries among the operating regions DN (D1 to D8).

That is, because the partition number is set to 1, the learning map 140 illustrated in each of FIGS. 10A and 10B is comprised of the single operating region DN (D1). Because the partition number is set to 4, the learning map 140 illustrated in FIG. 10C is comprised of the four operating regions DN (D1 to D4). Because the partition number is set to 8, the learning map 140 illustrated in FIG. 10D is comprised of the eight operating regions DN (D1 to D8).

FIG. 10A schematically illustrates the initial state of the learning map 140 immediately after the first travelling of the vehicle MV that has been recently shipped to a user. In the initial state, the learning map 140 is comprised of the single operating region D1 in which a target air-fuel ratio is stored, which is illustrated by a line L1 in FIG. 10A.

Note that, in FIG. 10A, a dashed line DL1 shows a distribution of ideal values of the target air-fuel ratio finally set for the respective operating regions D1 to D16 assuming that the single operating region D1 has been finally partitioned to the operating regions D1 to D16. Each of the ideal values of the target air-fuel ratio for the respective operating regions D1 to D16 represents a target air-fuel ratio set in the corresponding one of the operating regions D1 to D16 by the updating subroutine carried out by the updating unit 120; each of the ideal air-fuel ratios is suitable for the corresponding one of the present operating conditions of the vehicle MV. The dashed line DL1 is also illustrated in each of FIGS. 10B to 10D while being unchanged.

The value of the target air-fuel ratio shown by the line L1 in FIG. 10A represents a default value set in the operating region DN of the learning map 140 before shipping of the vehicle MV, so that the value of the target air-fuel ratio shown by the line L1 is deviated from the ideal values of the target air-fuel ratio.

Figure 9:
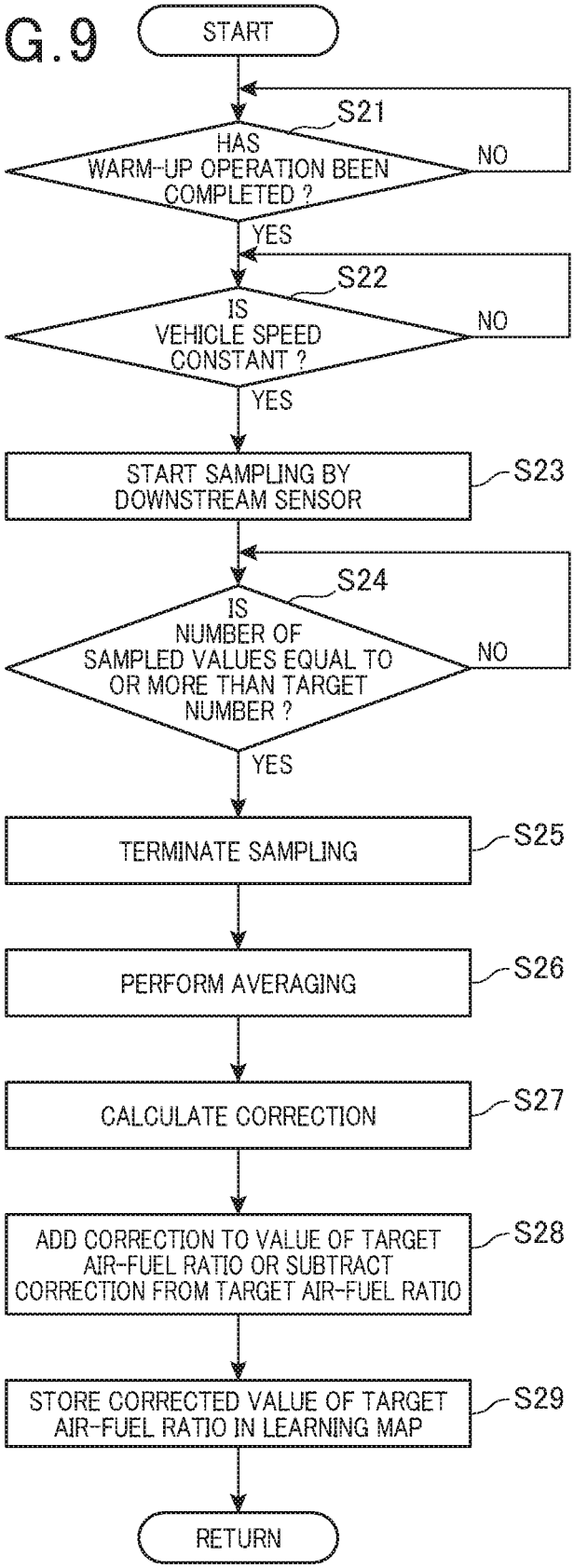
FIG. 9 is a flowchart schematically illustrating an updating subroutine carried out by the control device.

FIG. 10B schematically illustrates the state of the learning map 140 obtained by updating the initial state of the learning map 140 illustrated in FIG. 10A in accordance with the updating subroutine illustrated in FIG. 9. In FIG. 10B, an arrow attached to the horizontal axis represents the operating condition Y1 of the engine 11 at which the updating subroutine has been carried out. Because the learning map 140 has been updated when the engine 11 has the arrowed operating condition Y1, the value of the target air-fuel ratio stored in the operating region D1 shown by the line L1 is changed to a value corresponding to the operating condition Y1 of the engine 11 and shown by the dashed line DL1.

Specifically, because the number of partitions of the learning map 140 illustrated in each of FIGS. 10A and 10B is set to 1, the target air-fuel ratio stored in the learning map 140 for all the operating conditions of the engine is updated.

FIG. 10C schematically illustrates the state of the learning map 140 obtained by (1) Performing the partition-number increasing task for the state of the earning map 140 illustrated in FIG. 10B to thereby cause the learning map 140 to have the four operating regions DN (D1 to D4)

(2) Thereafter, updating each of the operating regions DN of the learning map 140 in accordance with the updating subroutine illustrated in FIG. 9.

Like FIG. 10B, in FIG. 10C, four arrows are attached to the horizontal axis, each of which represents the corresponding one of the operating conditions Y11 to Y14 of the engine 11 at which the corresponding updating subroutine has been carried out.

Because each of the operating regions D1 to D4 of the learning map 140 has been updated when the engine 11 has the corresponding one of the arrowed operating conditions Y11 to Y14, the values of the target air-fuel ratio stored in the respective operating regions D1 to D4 shown by the line L1 are individually set while they match with the theoretical air-fuel ratio (dashed line) DL1.

FIG. 10D schematically illustrates the state of the learning map 140 obtained by (1) Performing the partition-number increasing task for the state of the earning map 140 illustrated in FIG. 10C to thereby cause the learning map 140 to have the eight operating regions DN (D1 to D8)

(2) Thereafter, updating each of the operating regions DN of the learning map 140 in accordance with the updating subroutine illustrated in FIG. 9.

Like FIG. 10C, in FIG. 10D, eight arrows attached to the horizontal axis, each of which represents the corresponding one of the operating conditions Y21 to Y28 of the engine 11 at which the corresponding updating subroutine has been carried out.

As illustrated in FIGS. 10C and 10D, an increase in the number of partitions of the learning map 140 enables a distribution of the values of the target air-fuel ratio shown by the line L1 to approach the theoretical air-fuel ratio (dashed line) DL1.

Figure 11A:
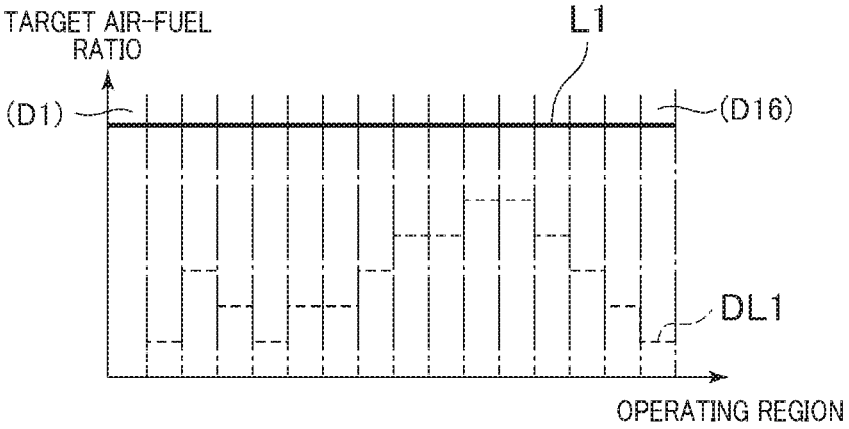
FIGS. 11A and 11B are a joint graphic diagram schematically illustrating how a learning map is changed according to a comparative example.
Figure 11B:
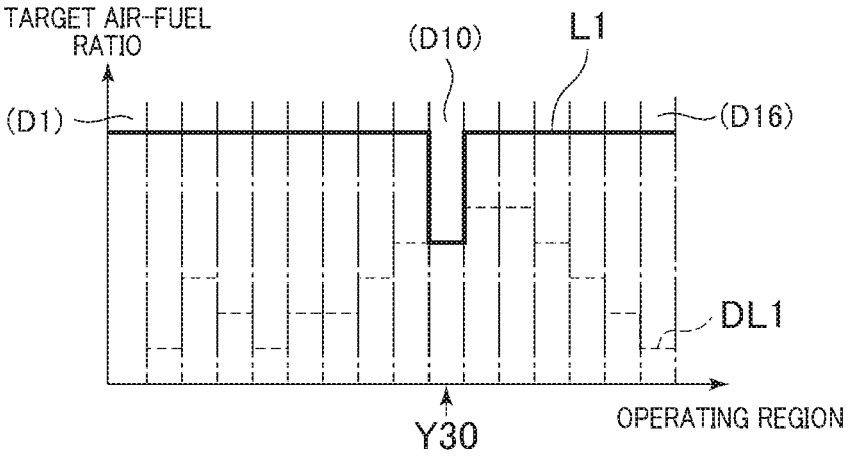

The following describes, with reference to FIGS. 11A and 11B, a comparison example of controlling the internal combustion engine 11 using the learning map 140 including partitioned 16 operating regions D1 to D16 whose partition number of 16 is fixed for describing benefits achieved by execution of the partition-number changing task and the updating subroutine.

Like FIG. 10A, FIG. 11A schematically illustrates the initial state of the learning map 140 immediately after the first travelling of the vehicle MV that has been recently shipped to a user. In FIG. 11A, the dashed line DL1 shows the distribution of ideal values of the target air-fuel ratio finally set for the respective operating regions D1 to D16, which is similar to the dashed line DL1 illustrated in FIG. 10A. In the initial state, the learning map 140 is comprised of the operating regions D1 to D16 in each of which a value of the target air-fuel ratio is stored, which is illustrated by a line L1 in FIG. 11A, which is the same as the line L1 in FIG. 10A.

FIG. 11A shows that the line L1 representing the values of the target air-fuel ratio stored in the respective operating regions D1 to D16 is deviated from the dashed line DL1 representing the ideal values of the target air-fuel ratio for the respective operating regions D1 to D16.

FIG. 11B schematically illustrates the state of the learning map 140 obtained by updating the state of the learning map 140 illustrated in FIG. 11A in accordance with the updating subroutine illustrated in FIG. 9. In FIG. 11B, an arrow attached to the horizontal axis represents the operating condition Y30 of the engine 11 in which the updating subroutine has been carried out. Because the learning map 140 has been updated when the engine 11 has the arrowed operating condition Y30, the value of the target air-fuel ratio stored in the operating region D10, which corresponds to the arrowed operating condition Y30, is changed to a value corresponding to the operating condition Y30 of the engine 11 and shown by the dashed line DL1.

In contrast, the other values of the target air-fuel ratio stored in the respective other operating regions D1 to D9 and D11 to D16 are not updated to be maintained as the same values shown by the line L1. This therefore may result in the values of the target air-fuel ratio stored in the other operating regions D1 to D9 and D11 to D1 being non-updated until the operating condition of the engine 11 is changed.

As seen by comparison between FIGS. 10B and 11B, execution of the first updating subroutine for the initial state of the learning map 140 illustrated in FIG. 10A enables the values of the at least one control parameter included in the whole area of the operating conditions of the engine 11 to be updated. This enables not only the value of the at least one control parameter, which is associated with the operating condition of the engine 11 at the updating time, but also the other values of the at least one control parameter, which are not associated with the operating condition of the engine 11 at the updating time, to be collectively updated to respective new values suitable for the changed operating condition of the engine 11.

This therefore enables any initial values of the at least one control parameter respectively stored in the operating regions DN of the learning map 140 to be updated, with a certain level of accuracy, to new values more suitable for the respective operating conditions of the engine 11 for a relatively shorter time. This makes it possible to reduce the frequency of updating of the at least one control parameter.

In the comparison example illustrated in FIGS. 11A and 11B, setting the number of partitions of the learning map 140 to be smaller enables the values of the at least one control parameter included in the wider area of the operating conditions of the engine 11 to be updated. Because the smaller number of partitions of the learning map 140 is maintained so that the resolution of the learning map 140 is maintained at a lower value, resulting in difficulty of the distribution of all the values of the at least one control parameter being completely in agreement with the ideal distribution of the values of the at least one control parameter as illustrated in the dashed line DL1.

Figure 12:
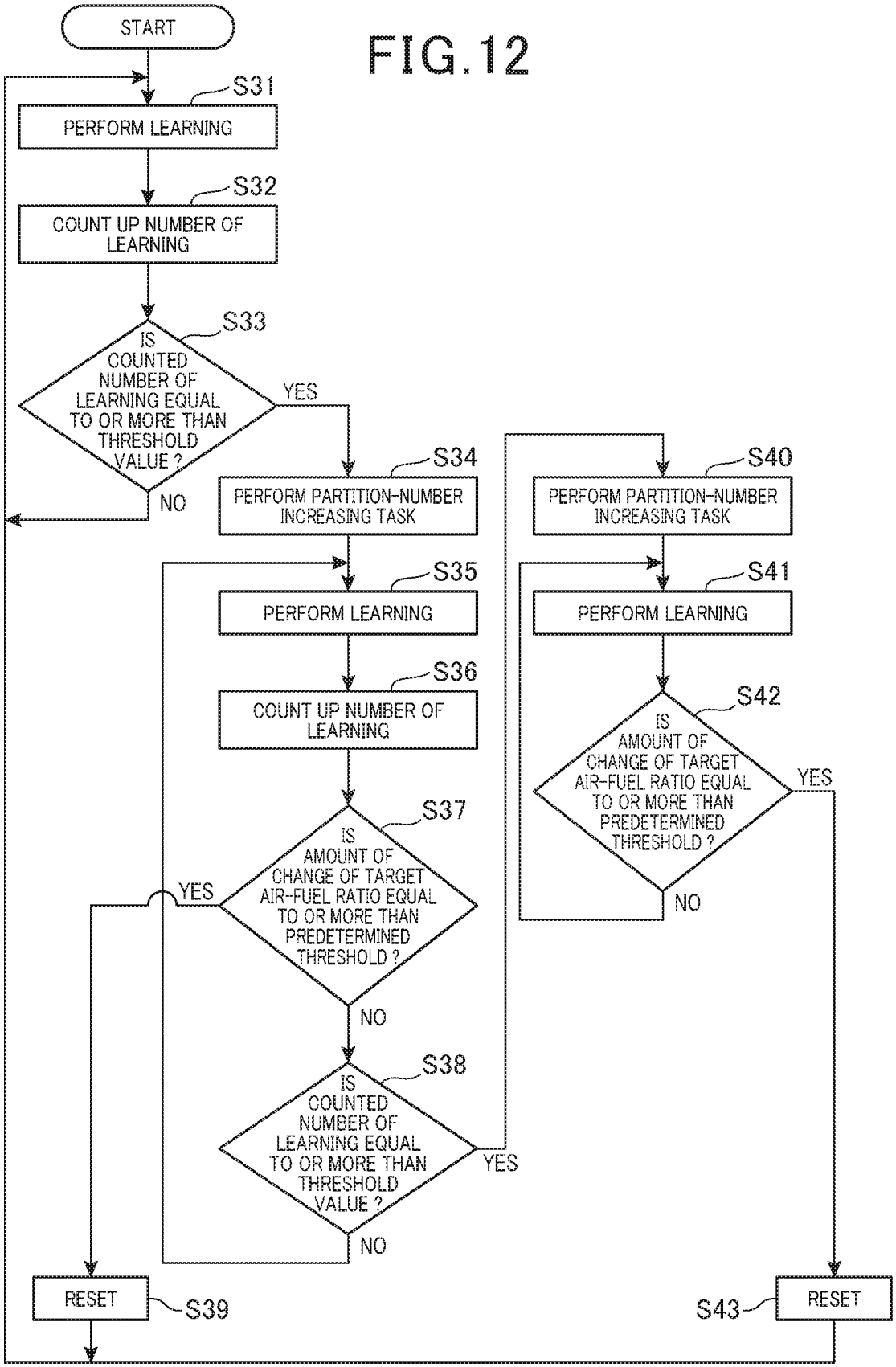
FIG. 12 is a flowchart schematically illustrating a partition changing routine carried out by the control device according to the first embodiment.

As described above, the control device 100 of the first embodiment is configured to change the number of partitions of the learning map 140 to thereby establish the compatibility between (1) Setting all values of the at least one control parameter, which respectively correspond to the operating conditions of the engine 11, with a certain level of accuracy (2) Finally setting all values of the at least one control parameter, which respectively correspond to the operating conditions of the engine 11, with higher accuracy Next, the following describes a partition changing routine carried out mainly by the partition changing unit 130 of the control device 100, i.e. its processor 100*a* with reference to FIG. 12. Note that a part, such as step S31 described later, of the partition changing routine is carried out by the updating unit 120. The control device 100, i.e. its processor 100*a*, of the first embodiment is programmed to start the partition changing routine when the number of partitions of the learning map 140 is set to 1.

In step S31, the updating unit 120 performs the updating subroutine for the learning map 140 in accordance with the flowchart illustrated in FIG. 9, thus updating the learning map 140 in response to when the determination in step S11 in FIG. 8 is affirmative. That is, the partition changing routine waits for completion of the operation in step S31, and the partition changing routine proceeds to step S32 after completion of the operation in step S31.

In step S32, the partition changing unit 130 counts the number of execution of the updating subroutine for the learning map 140, i.e. the number of learning of the learning map 140. That is, the partition changing unit 130 increments a count value, whose initial value of zero, indicative of the number of learning of the learning map 140 each time the operation in step S31 is performed. This enables the control device 100 to always monitor the number of learning of the learning map 140 that has been carried out.

Following the operation in step S32, the partition changing unit 130 determines whether the count value indicative of the number of learning of the learning map 140 is equal to or more than a predetermined threshold value in step S33. Upon determining that the count value indicative of the number of learning of the learning map 140 is less than the threshold value (NO in step S33), the partition changing unit 130 repeats the operations in steps S31 and S32. Otherwise, upon determining that the count value indicative of the number of learning of the learning map 140 is equal to or more than the threshold value (YES in step S33), the partition changing unit 130 performs the next operation in step S34.

In step S34, the partition changing unit 130 performs the partition-number increasing task set forth above. This changes the number of partitions of the learning map 140 from 1 to, for example, 4. This causes the values of the at least one control parameter, i.e. the values of the target air-fuel ratio, stored in the previous operating region(s) DN whose partition number has not been changed in step S34 to be restored in the present operating regions DN whose partition number has been changed in step S34. For example, the values of the at least one control parameter, i.e. the values of the target air-fuel ratio, stored in the previous single operating region DN (DN1) illustrated in FIG. 6A are subjected to the partition-number increasing task so as to be restored in the four operating regions DN (DN1 to DN4).

Subsequently, the updating unit 120 performs the updating subroutine for the learning map 140 in accordance with the flowchart illustrated in FIG. 9, thus updating the learning map 140 in response to when the determination in step S11 in FIG. 8 is affirmative in step S35, which is similar to the operation in step S31. That is, in step S35, the updating unit 120 performs the updating subroutine for a selected one of the operating regions DN whose partition number has increased by the partition-number increasing task; the selected one of the operating regions DN corresponds to the present operating condition of the engine 11. The partition changing routine waits for completion of the operation in step S35, and the partition changing routine proceeds to step S36 after completion of the operation in step S35.

In step S36, which is similar to the operation in step S32, the partition changing unit 130 counts the number of execution of the updating subroutine for the learning map 140, i.e. the number of learning of the learning map 140, after execution of the partition-number increasing task in step S34.

Following the operation in step S36, the partition changing unit 130 determines whether the amount of change of the at least one control parameter, i.e. the target air-fuel ratio, in the selected one of the operating regions DN is equal to or more than a predetermined threshold in step S37. The amount of change of the at least one control parameter, i.e. the target air-fuel ratio, in the selected one of the operating regions DN represents the absolute amount of difference between the updated value of the target air-fuel ratio in the selected one of the operating regions DN after execution of the operation in step S35 and the non-updated value of the target air-fuel ratio in the selected one of the operating regions DN before execution of the operation in step S35. That is, the amount of change of the at least one control parameter, i.e. the target air-fuel ratio, in the selected one of the operating regions DN is identical to the correction calculated in step S27 of FIG. 9.

The threshold has been determined, which enables a large variation of the target air-fuel ratio due to, for example, replacement of the upstream catalyst converter 14 to be determined.

When it is determined that the amount of change of the target air-fuel ratio in the selected one of the operating regions DN is equal to or more than the predetermined threshold (YES in step S37), the partition changing routine proceeds to step S39.

In step S39, the partition changing unit 130 performs a reset task that returns the number of partitions of the learning map 140 to the initial value of 1, and returns the count value to the initial value of zero. The reset task can be included in the partition-number decreasing task. The reset task can return the values of the target air-fuel ratio stored in the learning map 140 to their initial values.

After the reset task, the partition changing routine returns to step S31, and the control device 100 repeats the partition changing routine again. This enables the values of the at least one control parameter stored in the wide area of the learning map 140 to be updated again, which has been described with reference to FIG. 10B. This makes it possible to bring the values of the learning map 140 after replacement of the upstream catalyst 140 to close to their proper values in a short time.

Otherwise, when it is determined that the amount of change of the target air-fuel ratio in the selected one of the operating regions DN is less than the predetermined threshold (NO in step S37), the partition changing routine proceeds to step S38.

In step S38, the partition changing unit 130 determines whether the count value indicative of the number of learning of the learning map 140, which has been counted up in step S36, is equal to or more than a predetermined threshold value. The threshold value can be set to be equal to or different from the threshold value used in step S33.

Upon determining that the count value indicative of the number of learning of the learning map 140 is less than the threshold value (NO in step S38), the partition changing unit 130 or the updating unit 120 repeats the operations in steps S35 to S37. Otherwise, upon determining that the count value indicative of the number of learning of the learning map 140 is equal to or more than the threshold value (YES in step S38), the partition changing unit 130 performs the next operation in step S40.

Note that the counting-up operation in step S36 can be performed for the whole of the learning map 140 or for the selected one of the operating regions DN. When the counting-up operation in step S36 is performed for the selected one of the operating regions DN, the operation in step S38 can determine whether the count value indicative of the number of learning of any one of the operating regions DN is equal to or more than the threshold value, or whether the count value indicative of the number of learning of each of the operating regions DN is equal to or more than the threshold value.

In step S40, the partition changing unit 130 performs the partition-number increasing task set forth above. This changes the number of partitions of the learning map 140 from 4 to, for example, 8. This causes the values of the at least one control parameter, i.e. the values of the target air-fuel ratio, stored in the previous operating regions DN whose partition number has not been changed in step S40 to be restored in the present operating regions DN whose partition number has been changed in step S40.

Subsequently, the updating unit 120 performs the updating subroutine for the learning map 140 in accordance with the flowchart illustrated in FIG. 9, thus updating the learning map 140 in response to when the determination in step S11 in FIG. 8 is affirmative in step S41, which is similar to the operation in step S31 or in step S35. That is, in step S41, the updating unit 120 performs the updating subroutine for a selected one of the operating regions DN whose partition number has increased by the partition-number increasing task; the selected one of the operating regions DN corresponds to the present operating condition of the engine 11. The partition changing routine waits for completion of the operation in step S41, and the partition changing routine proceeds to step S42 after completion of the operation in step S41.

In step S42, the partition changing unit 130 determines whether the amount of change of the at least one control parameter, i.e. the target air-fuel ratio, in the selected one of the operating regions DN is equal to or more than the predetermined threshold, which is similar to the operation in step S37.

When it is determined that the amount of change of the target air-fuel ratio in the selected one of the operating regions DN is equal to or more than the predetermined threshold (YES in step S42), the partition changing unit 130 performs the reset task in the same manner as the operation in step S37.

Otherwise, when it is determined that the amount of change of the target air-fuel ratio in the selected one of the operating regions DN is less than the predetermined threshold (NO in step S42), the partition changing unit 130 or the updating unit 120 repeats the operations in steps S41 and S42.

As described above, the partition changing unit 130 of the first embodiment is configured to determine whether the number of updating of the at least one control parameter included in the learning map 140 (see step S33 or step S38), and perform the partition-number increasing task upon determining that the number of updating of the at least one control parameter is equal to or more than the threshold value (YES in step S33 or YES in step S38). This configuration prevents execution of the next partition-number increasing task although there is a large deviation between the at least one control parameter and the ideal values of the at least one control parameter (see the dashed line DL1 in FIG. 10 as an example).

Note that an additional condition can be added to the actual condition that the partition changing routine proceeds to the next step S34 or S40. For example, the partition changing unit 130 can be configured to perform the partition-number increasing task when the deviation between an actual value measured by the upstream sensor 200 and a corresponding value of the target air-fuel ratio is smaller than a predetermined deviation.

The first embodiment uses, as the at least one control parameter required to control the engine 11, values of the target air-fuel ratio, i.e. the target values for the air-fuel ratio measured by the upstream sensor 200. This enables the maximum of the cleaning performance of the upstream catalytic converter 14 to be obtained independently of the individual variations of the vehicle MV relative to the other same-type vehicles. This therefore enables the downstream catalytic converter 15 to be eliminated.

As described above with reference to FIG. 9, the updating unit 120 according to the first embodiment is configured to update the at least one control parameter based on actual values of the air-fuel ratio measured by the downstream sensor 300 to thereby update the learning map 140. This configuration enables a value of the target air-fuel ratio to be properly set even if the catalyst of the catalytic converter 14 has deteriorated so that its cleaning performance has been changed over time.

Second Embodiment

Figure 13:
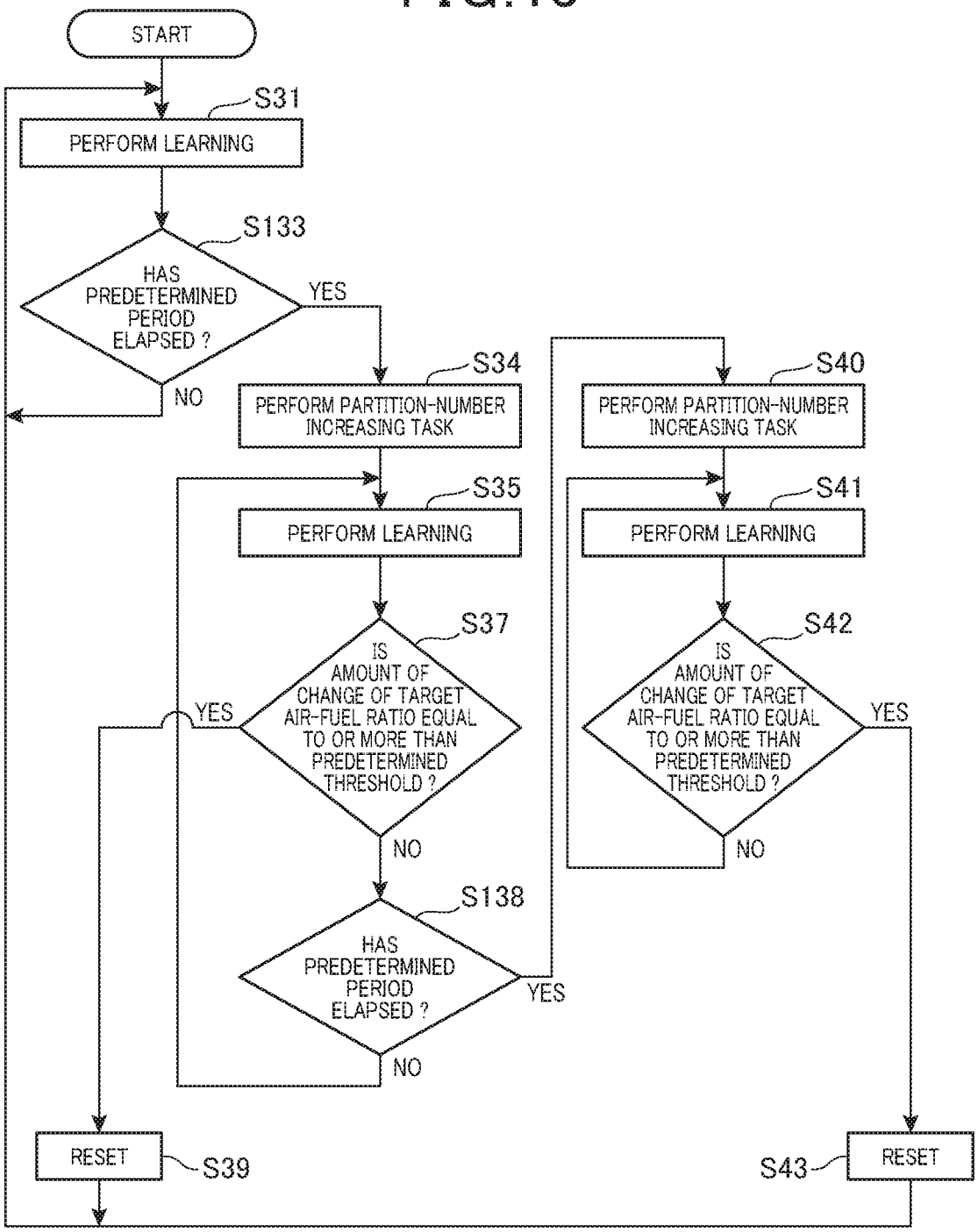
FIG. 13 is a flowchart schematically illustrating a partition changing routine carried out by the control device according to the second embodiment of the present disclosure.

The following describes a control device according to the second embodiment of the present disclosure with reference to FIG. 13. The configuration and functions of the control device according to the second embodiment are mainly different from those of the control device 100 according to the first embodiment by the following points. The following therefore mainly describes the different points.

The following describes a partition changing routine, which is illustrated in FIG. 13, carried out mainly by the partition changing unit 130 of the control device 100, i.e. its processor 100*a*, in place of the partition changing routine illustrated in FIG. 12.

The partition changing routine illustrated in FIG. 13 is configured such that the operation in step S33 of the partition changing routine illustrated in FIG. 12 is replaced with the operation in step S133, and the operation in step S38 is replaced with the operation in step S138. In addition, the operations in steps S32 and S36 of the partition changing routine illustrated in FIG. 12 are eliminated from the partition changing routine illustrated in FIG. 13.

That is, the partition changing routine proceeds to step S133 after completion of the updating subroutine in step S31.

In step S133, the partition changing unit 130 determines whether a predetermined period has elapsed since the start of the partition changing routine. The predetermined period is previously set to the length of time for which the updating subroutine for the selected one of the operating regions DN corresponding to the actual operating condition of the engine 11 is estimated to be completed. When it is determined that the predetermined period has not elapsed (NO in step S133), the updating unit 120 repeatedly performs the updating subroutine for the selected one of the operating regions DN of the learning map 140 in step S31. Otherwise, when it is determined that the predetermined period has elapsed (YES in step S133), the partition changing routine proceeds to step S34, and the following operations from step S34 are performed in the same manner as the partition changing routine illustrated in FIG. 12.

When it is determined that the amount of change of the target air-fuel ratio in the selected one of the operating regions DN is less than the predetermined threshold (NO in step S37), the partition changing routine proceeds to step S138.

In step S138, the partition changing unit 130 determines whether the predetermined period has elapsed since completion of the partition-number increasing task in step S34. When it is determined that the predetermined period has not elapsed (NO in step S138), the updating unit 120 repeatedly performs the updating subroutine for the selected one of the operating regions DN of the learning map 140 in step S35. Otherwise, when it is determined that the predetermined period has elapsed (YES in step S138), the partition changing routine proceeds to step S40, and the following operations from step S40 are performed in the same manner as the partition changing routine illustrated in FIG. 12.

As described above, the partition changing unit 130 according to the second embodiment is configured to perform the partition-number increasing task each time the predetermined period, which can be equal to or different from each other, has elapsed. This configuration enables the number of partitions of the learning map 140 to be gradually increased.

Third Embodiment

Figure 14:
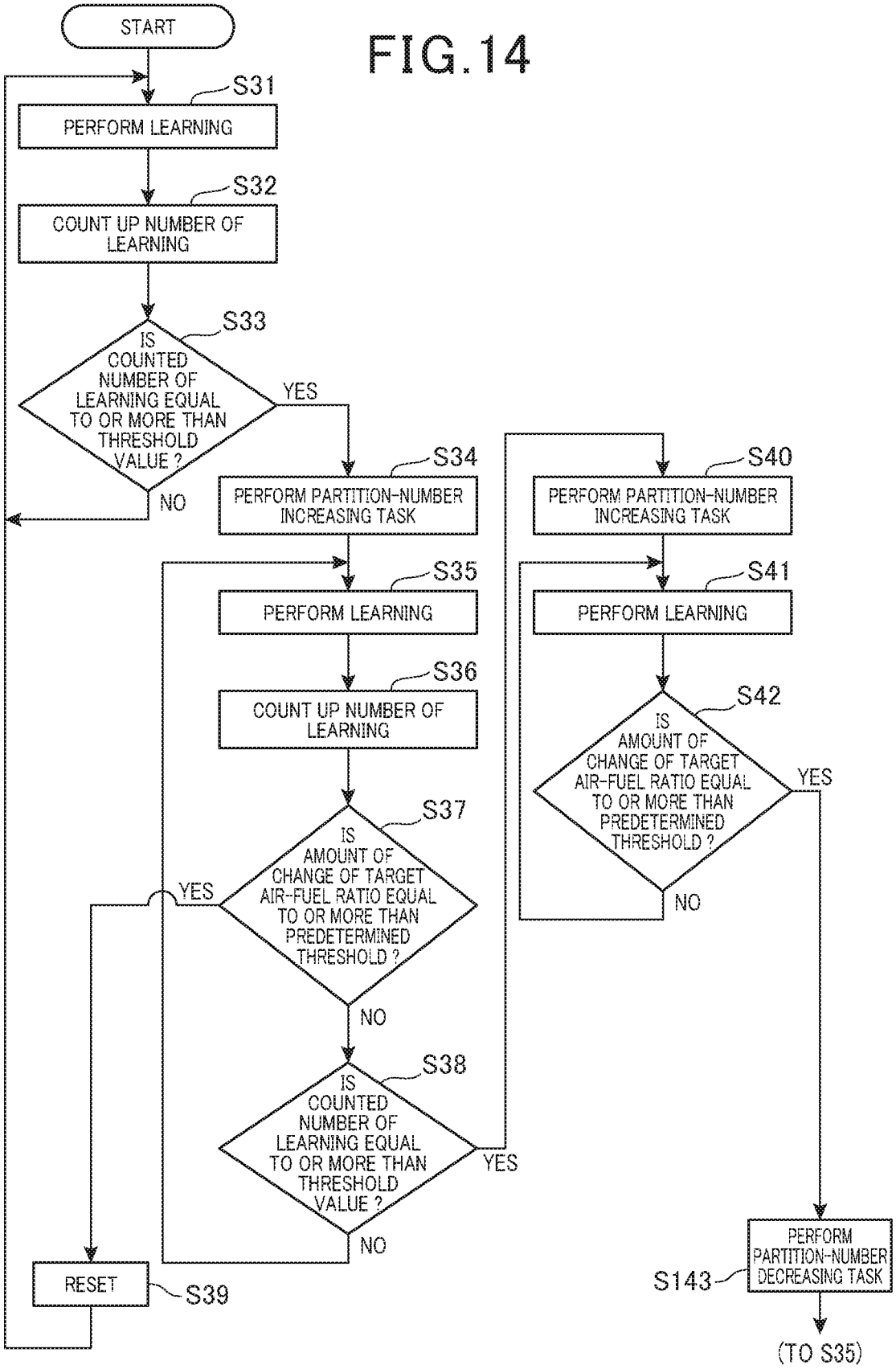
FIG. 14 is a flowchart schematically illustrating a partition changing routine carried out by the control device according to the third embodiment of the present disclosure.

The following describes a control device according to the third embodiment of the present disclosure with reference to FIG. 14. The configuration and functions of the control device according to the third embodiment are mainly different from those of the control device 100 according to the first embodiment by the following points. The following therefore mainly describes the different points.

The following describes a partition changing routine, which is illustrated in FIG. 14, carried out mainly by the partition changing unit 130 of the control device 100, i.e. its processor 100*a*, in place of the partition changing routine illustrated in FIG. 12.

The partition changing routine illustrated in FIG. 14 is configured such that the operation in step S43 of the partition changing routine illustrated in FIG. 12 is replaced with the operation in step S143, and thereafter, the partition changing routine proceeds to step S35.

That is, when it is determined that the amount of change of the target air-fuel ratio in the selected one of the operating regions DN is equal to or more than the predetermined threshold (YES in step S42), the partition changing unit 130 proceeds to step S143.

In step S143, the partition changing unit 130 performs the partition-number decreasing task set forth above. This results in the number of partitions of the learning map 140 being returned to the previous number of partitions of the learning map 140 before execution of the partition-number increasing task in step S40. At that time, as the value of each the operating regions, which will be referred to as DNA, of the learning map 140 after the partition-number decreasing task has been carried out, one of the values of the corresponding operating regions, which will be referred to as DNB, of the learning map 140 before the partition-number decreasing task has been carried out. After completion of the operation in step S143, the partition changing routine proceeds to step S35.

As described above, the partition changing unit 130 according to the third embodiment is configured to perform the partition-number decreasing task when the amount of change of the target air-fuel ratio in the selected one of the operating regions DN is equal to or more than the predetermined threshold based on execution of the updating of the at least one control parameter by the updating unit 120 in step S41.

That is, when the amount of change of the target air-fuel ratio in the selected one of the operating regions DN is equal to or more than the predetermined threshold, the deviation of the target value of at least part of the operating regions DN from the corresponding value of the ideal distribution of the at least one control parameter (see the dashed line DL1 in FIG. 10) is estimated to relatively increase. This configuration of the third embodiment enables the deviation to be reduced.

Fourth Embodiment

Figure 15:
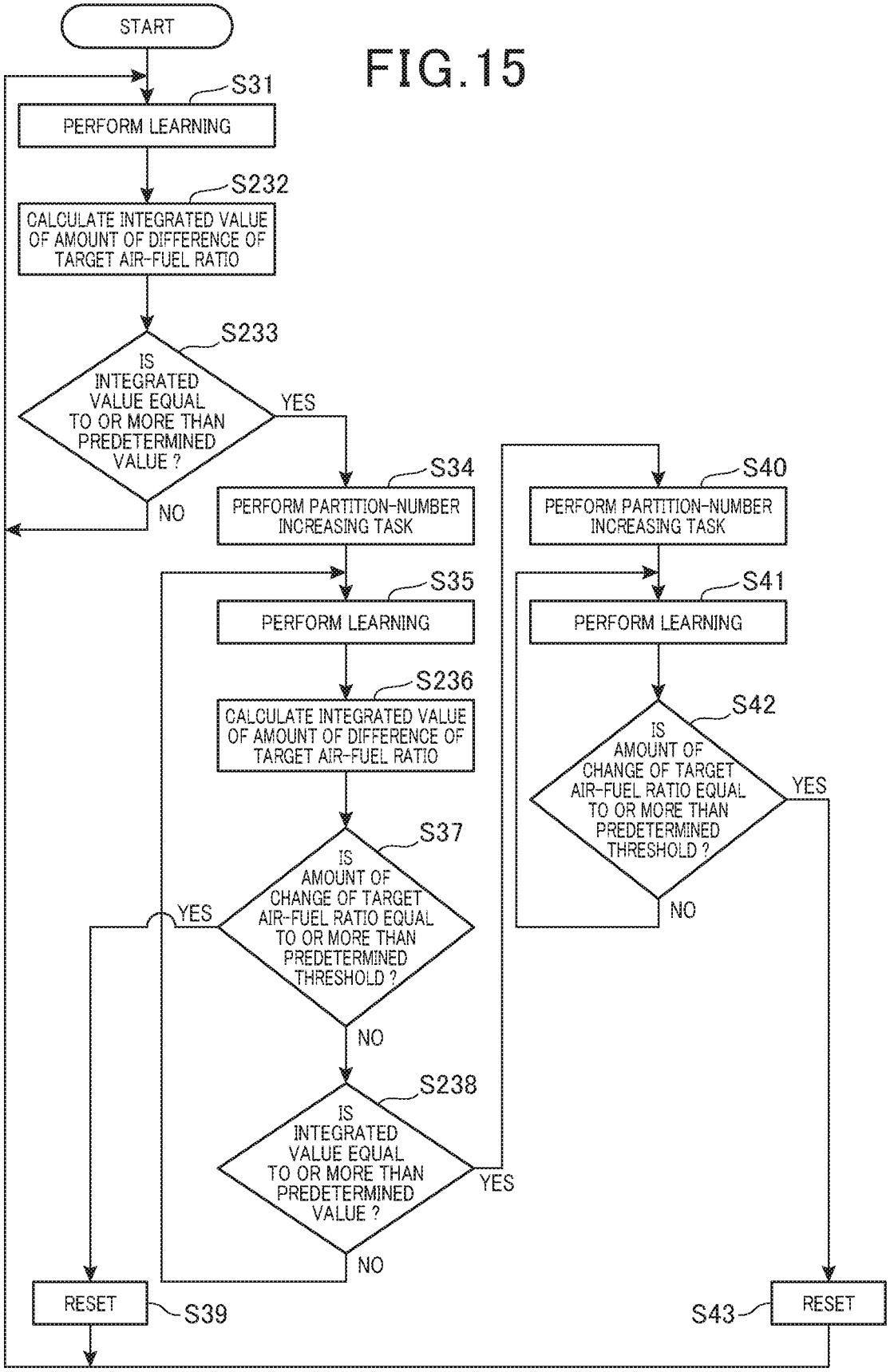
FIG. 15 is a flowchart schematically illustrating a partition changing routine carried out by the control device according to the fourth embodiment of the present disclosure.

The following describes a control device according to the fourth embodiment of the present disclosure with reference to FIG. 15. The configuration and functions of the control device according to the fourth embodiment are mainly different from those of the control device 100 according to the first embodiment by the following points. The following therefore mainly describes the different points.

The following describes a partition changing routine, which is illustrated in FIG. 14, carried out mainly by the partition changing unit 130 of the control device 100, i.e. its processor 100*a*, in place of the partition changing routine illustrated in FIG. 12.

The partition changing routine illustrated in FIG. 14 is configured such that (1) The operation in step S32 of the partition changing routine illustrated in FIG. 12 is replaced with the operation in step S232

(2) The operation in step S33 is replaced with the operation in step S233

(3) The operation in step S36 is replaced with the operation in step S236

(4) The operation in step S38 is replaced with the operation in step S238

That is, the partition changing routine illustrated in FIG. 15 proceeds to step S232 after completion of the updating subroutine of the learning map 140 in step S31.

In step S232, the partition changing unit 130 calculates an integrated value of the amounts of change of the at least one control parameter, i.e. the target air-fuel ratio, in the selected one of the operating regions DN, which have been obtained by repeat executions of the updating subroutine until now. That is the integrated value is obtained by (1) Calculating the absolute amount of difference between the updated value of the target air-fuel ratio in the selected one of the operating regions DN after execution of the updating subroutine and the non-updated value of the target air-fuel ratio in the selected one of the operating regions DN before execution of the updating subroutine for each execution of the updating subroutine, which corresponds to the correction for the corresponding one of the operating regions DN (2) Integrating the absolute amounts of difference for the selected one of the operating regions DN that have been obtained until now each time the new updating subroutine is carried out In step S233, the partition changing unit 130 determines whether the integrated value calculated in step S232 is equal to or more than a predetermined value.

When it is determined that the integrated value is less than the predetermined value (NO in step S233), the updating unit 120 repeatedly performs the updating subroutine of the learning map 140 in step S31. Otherwise, when it is determined that the integrated value is equal to or more than the predetermined value (YES in step S233), the partition changing routine proceeds to step S34, and the following operations from step S34 are performed in the same manner as the partition changing routine illustrated in FIG. 12.

Similarly, after the updating subroutine is carried out, the partition changing unit 130 calculates the integrated value of the amounts of change of the at least one control parameter, i.e. the target air-fuel ratio, in the selected one of the operating regions DN, which have been obtained by repeat executions of the updating subroutine until now in step S236, which is similar to the operation in step S232. Thereafter, the partition changing routine proceeds to step S37.

When it is determined that the amount of change of the target air-fuel ratio in the selected one of the operating regions DN is less than the predetermined threshold (NO in step S37), the partition changing routine proceeds to step S238.

In step S238, the partition changing unit 130 determines whether the integrated value calculated in step S236 is equal to or more than the predetermined value.

When it is determined that the integrated value is less than the predetermined value (NO in step S238), the updating unit 120 repeatedly performs the updating subroutine of the learning map 140 in step S35. Otherwise, when it is determined that the integrated value is equal to or more than the predetermined value (YES in step S238), the partition changing routine proceeds to step S40, and the following operations from step S40 are performed in the same manner as the partition changing routine illustrated in FIG. 12.

As described above, the partition changing unit 130 according to the second embodiment is configured to perform the partition-number increasing task each time the integrated value of the amounts of change of the at least one control parameter, i.e. the target air-fuel ratio, in the selected one of the operating regions DN, which have been obtained by repeat executions of the updating subroutine until now. This configuration achieves the same benefits as those achieved by the first embodiment.

In step S232 or S236, the partition changing unit 130 can use, in place of the absolute amount, the amount of difference between the updated value of the target air-fuel ratio in the selected one of the operating regions DN after execution of the updating subroutine and the non-updated value of the target air-fuel ratio in the selected one of the operating regions DN before execution of the updating subroutine.

In step S232 or S236, the partition changing unit 130 can calculate, in place of the integrated value, the amount of difference between the updated value of the target air-fuel ratio in the selected one of the operating regions DN after execution of the updating subroutine and the non-updated value of the target air-fuel ratio in the selected one of the operating regions DN before execution of the updating subroutine. In this modification, in step S233 or S238, the partition changing unit 130 determines whether the absolute amount of difference or the amount of difference calculated in step S232 or S236 is equal to or more than a predetermined value.

Fifth Embodiment

Figure 16A:
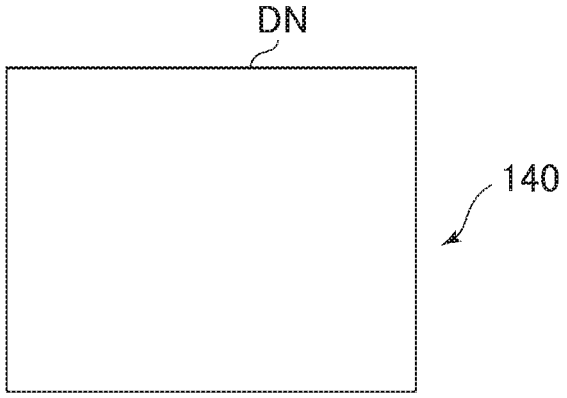
FIGS. 16A to 16C are a joint diagram schematically illustrating how the number of partitions of the learning map is changed by a partition-number increasing task according to the fifth embodiment of the present disclosure.
Figure 16B:
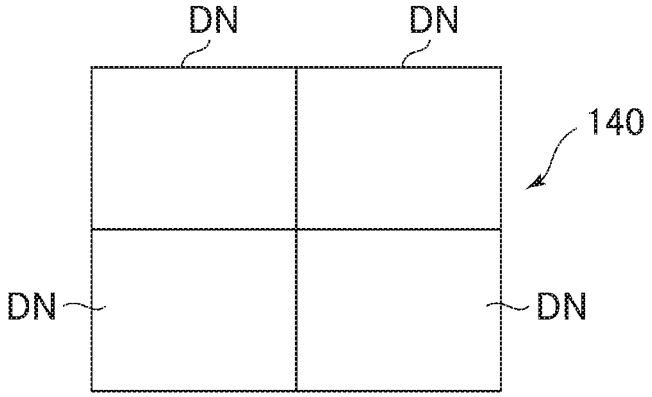
Figure 16C:
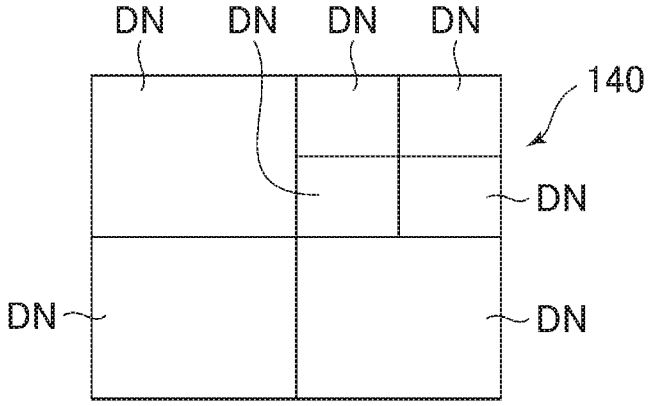

The following describes a control device according to the fifth embodiment of the present disclosure with reference to FIGS. 16A to 16C. The configuration and functions of the control device according to the fifth embodiment are mainly different from those of the control device 100 according to the first embodiment by the following points. The following therefore mainly describes the different points.

In particular, the partition-number changing task according to the fifth embodiment is different from the partition-number changing task according to the first embodiment.

FIGS. 16A to 16C, which respectively correspond to FIGS. 6A to 6C, illustrate how the number of partitions of the learning map 140 is changed by the partition-number increasing task as the partition-number changing task.

Specifically, the partition-number increasing task causes the learning map 140 whose partition number is 1 (see FIG. 16A) to be changed to the learning map 140 whose partition number is changed from 1 to 4 (see FIG. 16B). Additionally, the partition-number increasing task causes the learning map 140 whose partition number is 4 (see FIG. 16B) to be changed to the learning map 140 such that (1) The partition number of the changed learning map 140 has 8

(2) A specific region, for example, the upper right region in the four operating regions DN is only partitioned to four operating regions DN That is, the partition-number increasing task is configured not to partition the operating regions DN equally, but to partition at least one specific operating region in the operating regions DN to form narrower operating regions. This configuration achieves the same benefits as those achieved by the first embodiment.

For example, in a case where some specific operating regions in the operating region DN are only used for users who mostly use the vehicle MV in a close range, the partition-number increasing task can be configured to only partition each of the specific operating regions as early as possible, and thereafter further partition each of the remaining operating regions. This enables a part of the operating regions DN, which is frequently used by users, to be finely partitioned, so that the target values of each of the specific regions of the learning parameter 140 are determined earlier with higher accuracy.

Similarly, FIGS. 16C to 16A, which respectively correspond to FIGS. 6C to 6A, illustrate how the number of partitions of the learning map 140 is changed by the partition-number decreasing task as the partition-number changing task.

Specifically, the partition-number decreasing task causes the learning map 140 whose partition number is 8 (see FIG. 16C) to be changed to the learning map 140 such that (1) The partition number of the changed learning map 140 is 4

(2) A specific region, for example, the upper right region in the four operating regions DN is returned to be only non-partitioned The partition changing unit 130 according to each of the first to fifth embodiment is configured to change the number of partitions of the learning map 140 at (1) A timing when the number of learning of the learning map 140 is equal to or more than the predetermined threshold value, or (2) A timing when the predetermined period has elapsed since the start of the partition changing routine.

The partition changing unit 130 according to the present disclosure can be configured to change the number of partitions of the learning map 140 at a selected one of timings different from the above timings described in the embodiments.

Specifically, the partition changing unit 130 can be configured to perform one of the partition-number increasing task and partition-number decreasing task each time the type, such as an express way or an urban road, of a vehicle on which the vehicle MV is going to be travelling is changed to another type, thus changing the number of partitions of the learning map 140.

The partition changing unit 130 according to the present disclosure can be configured to perform the partition-number decreasing task for a case of ensuring the learning speed due to any cause, and perform the partition-number increasing task for a case of ensuring the learning accuracy.

The changing of the partition pattern or partition format of the learning map 140 carried out by the partition changing routine 130 includes (1) Changing of the number of partitions of the learning map 140

(2) Changing the area of each operating region DN while maintaining the number of partitions unchanged The partition changing unit 130 can be configured to change the partition pattern of the learning map 140 using one of various methods.

For example, the partition changing unit 130 can be configured to overwrite a prepared new learning map 140 having a desire partition pattern into the previous learning map 140 stored in, for example, a predetermined storage area of the memory 100*b*.

Alternatively, the partition changing unit 130 can be configured to select one of various learning maps having different desire partition patterns, thus changing the previous learning map 140 into the selected learning map.

The first method is preferable in view of smaller storage space ensured for the learning map 140 in the memory 100*b*.

The embodiments have been described with reference to the specific examples. However, the present disclosure is not limited to the specific examples. Design changes to the specific examples made as appropriate by a person having ordinary skill in the art are also included in the scope of the present disclosure as long as they have the features of the present disclosure. The elements and their arrangements, conditions, shapes, and the like of the specific examples described above are not limited to those shown as examples, but may be changed as appropriate. The elements of the specific examples described above may be differently combined as appropriate as long as no technical contradiction arises.

What is claimed is:

1. A control device for an internal combustion engine, the control device comprising:

a learning map including:

a plurality of partitioned operating regions, each of the partitioned operating regions corresponding to one of operating conditions of the internal combustion engine; and values of at least one control parameter stored in the respective partitioned operating regions;

a control unit configured to control the internal combustion engine in accordance with the at least one control parameter;

an updating unit configured to learn a value of the at least one control parameter for at least one of the operating conditions, thus performing an updating of the value of the at least one control parameter stored in at least one of the partitioned operating regions to the learned value; and a partition changing unit configured to:

change a partition pattern of the learning map; and perform a partition-number increasing task to increase the number of partitions of the learning map as an operation of the internal combustion engine advances from an initial state of the internal combustion engine to thereby cause at least part of the partitioned operating regions to be narrower, wherein the partition-number increasing task is performed by the partition changing until upon determining that an amount of change between the updated value of the at least one control parameter after the updating by the updating unit and the value of the at least one control parameter before the updating by the updating unit is equal to or more than a predetermined threshold value.

2. The control device according to claim 1, wherein:

the partition changing unit is further configured to perform the partition-number increasing task upon determining that the number of updates of the at least one control parameter by the updating unit is equal to or more than a predetermined number.

3. The control device according to claim 1, wherein:

the partition changing unit is further configured to:

integrate the amount of change each time the updating is carried out by the updating unit to thereby calculate an integrated value of the amount of change; and perform the partition-number increasing task upon determining that the integrated value of the amount of change is equal to or more than a predetermined threshold value.

4. The control device according to claim 1, wherein:

the partition changing unit is further configured to perform a partition-number decreasing task to decrease the number of partitions of the learning map to thereby cause at least part of the partitioned operating regions to be wider.

5. The control device according to claim 4, wherein:

the partition changing unit is further configured to perform the partition-number decreasing task upon determining that an amount of change between the updated value of the at least one control parameter after the updating by the updating unit and the value of at least one control parameter before the updating by the updating unit is equal to or more than a predetermined threshold value.

6. The control device according to claim 1, wherein:

the internal combustion engine is installed in a vehicle;

the vehicle comprises:

an exhaust passage through which exhaust gas discharged from the internal combustion engine passes;

a catalytic converter provided in the exhaust passage for cleaning the exhaust gas;

an upstream sensor configured to measure a first air-fuel ratio based on a first part of the exhaust gas located upstream of the catalytic converter; and a downstream sensor configured to measure a second air-fuel ratio based on a second part of the exhaust gas located downstream of the catalytic converter; and the at least one control parameter is a target air-fuel ratio for the first air-fuel ratio measured by the upstream sensor.

7. The control device according to claim 6, wherein:

the updating unit is further configured to perform the updating of the value of the target air-fuel ratio as the at least one control parameter in accordance with the second air-fuel ratio measured by the downstream sensor.

8. The control device according to claim 6, wherein:

each of the upstream and downstream sensors is designed as a linear sensor that changes, depending on change of the corresponding one of the first and second air-fuel ratios, an output signal thereof with a constant gradient.

9. The control device according to claim 8, wherein:

each of the upstream and downstream sensors is designed to have one-cell structure.

10. A control device for an internal combustion engine, the control device comprising:

non-transitory storage memory storing a learning map, the learning map including:

a plurality of partitioned operating regions, each of the partitioned operating regions corresponding to one of operating conditions of the internal combustion engine; and values of at least one control parameter stored in the respective partitioned operating regions;

a processor at least configured to:

control the internal combustion engine in accordance with the at least one control parameter;

learn a value of the at least one control parameter for at least one of the operating conditions;

perform an updating of the value of the at least one control parameter stored in the at least one of the partitioned operating regions to the learned value;

change a partition pattern of the learning map; and perform a partition-number increasing task to increase the number of partitions of the learning map as an operation of the internal combustion engine advances from an initial state of the internal combustion engine to thereby cause at least part of the partitioned operating regions to be narrower, wherein the partition-number increasing task is performed upon determining that an amount of change between the updated value of the at least one control parameter after the updating and the value of the at least one control parameter before the updating is equal to or more than a predetermined threshold value.

11. The control device according to claim 10, wherein:

the processor is further configured to perform the partition-number increasing task upon determining that the number of updates of the at least one control parameter is equal to or more than a predetermined number.

12. The control device according to claim 10, wherein:

the processor is further configured to perform the partition-number increasing task upon determining that an amount of change between the updated value of the at least one control parameter after the updating and the value of at least one control parameter before the updating is equal to or more than a predetermined threshold value.

13. The control device according to claim 10, wherein:

the processor is further configured to:

integrate the amount of change each time the updating is performed to thereby calculate an integrated value of the amount of change; and perform the partition-number increasing task upon determining that the integrated value of the amount of change is equal to or more than a predetermined threshold value.

14. The control device according to claim 10, wherein:

the processor is further configured to perform a partition-number decreasing task to decrease the number of partitions of the learning map to thereby cause at least part of the partitioned operating regions to be wider.

15. The control device according to claim 14, wherein:

the processor is further configured to perform the partition-number decreasing task upon determining that an amount of change between the updated value of the at least one control parameter after the updating and the value of at least one control parameter before the updating is equal to or more than a predetermined threshold value.

16. The control device according to claim 10, wherein:

the internal combustion engine is installed in a vehicle; and the vehicle comprises:

an exhaust passage through which exhaust gas discharged from the internal combustion engine passes;

a catalytic converter provided in the exhaust passage for cleaning the exhaust gas;

an upstream sensor configured to measure a first air-fuel ratio based on a first part of the exhaust gas located upstream of the catalytic converter; and a downstream sensor configured to measure a second air-fuel ratio based on a second part of the exhaust gas located downstream of the catalytic converter; and the at least one control parameter is a target air-fuel ratio for the first air-fuel ratio measured by the upstream sensor.

17. The control device according to claim 16, wherein:

the processor is further configured to perform the updating of the value of the target air-fuel ratio as the at least one control parameter in accordance with the second air-fuel ratio measured by the downstream sensor.

18. The control device according to claim 16, wherein:

each of the upstream and downstream sensors is designed as a linear sensor that changes, depending on change of the corresponding one of the first and second air-fuel ratios, an output signal thereof with a constant gradient.

19. The control device according to claim 18, wherein:

each of the upstream and downstream sensors is designed to have one-cell structure.

* * * * *